US007915828B2

(12) United States Patent
Hamada et al.

(10) Patent No.: US 7,915,828 B2
(45) Date of Patent: Mar. 29, 2011

(54) HIGH-VOLTAGE PULSE GENERATOR, AND LIGHTING APPARATUS AND VEHICLE HAVING THE SAME

(75) Inventors: Hideki Hamada, Osaka (JP); Noriyuki Satou, Osaka (JP); Yoshihiko Shimizu, Hyogo (JP); Seiji Kohashi, Hyogo (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 198 days.

(21) Appl. No.: 11/909,847

(22) PCT Filed: Mar. 28, 2006

(86) PCT No.: PCT/IB2006/050931

§ 371 (c)(1),
(2), (4) Date: Sep. 27, 2007

(87) PCT Pub. No.: WO2006/103621

PCT Pub. Date: Oct. 5, 2006

(65) Prior Publication Data

US 2008/0191627 A1 Aug. 14, 2008

(30) Foreign Application Priority Data

Mar. 28, 2005 (JP) ..... 2005-093111

(51) Int. Cl.
*H01J 23/16* (2006.01)

(52) U.S. Cl. ..... 315/55; 315/56; 315/57

(58) Field of Classification Search ..... 315/55–58, 315/78, 62, 70, 71, 82, 177, 291, 326, 354, 315/209, 210, 212, 218, 219, 221, 224, 225
See application file for complete search history.

(56) References Cited

U.S. PATENT DOCUMENTS

| | | | |
|---|---|---|---|
| 2002/0180572 | A1 | 12/2002 | Kakehashi et al. |
| 2007/0170873 | A1 | 7/2007 | Mishima |
| 2007/0210727 | A1 | 9/2007 | Sun et al. |

FOREIGN PATENT DOCUMENTS

| | | |
|---|---|---|
| EP | 1 311 143 | 5/2003 |
| JP | 8-298190 | 11/1996 |
| JP | 2002-216534 | 8/2002 |
| JP | 2002-217050 | 8/2002 |
| JP | 2002-217050 A | 8/2002 |
| JP | 2002217050 | 8/2002 |
| JP | 2003-115396 | 4/2003 |
| JP | 2004-206974 | 7/2004 |

OTHER PUBLICATIONS

English language Abstract of JP 2002-217050A, Aug. 2, 2002.
English language Abstract of JP 2002-217050.

*Primary Examiner* — Douglas W Owens
*Assistant Examiner* — Jianzi Chen
(74) *Attorney, Agent, or Firm* — Greenblum & Bernstein, P.L.C.

(57) ABSTRACT

There is provided a high-voltage pulse generator with a reduced radius of rotation and improved performance, and a lighting apparatus and a vehicle having the high-voltage pulse generator. The high-voltage pulse generator includes a pulse transformer in which a primary winding and a secondary winding are wound on a core, a discharge lamp connector which is formed in a tube shape having an opened front surface and a bottom out of an insulating material and which has an inner-electrode terminal electrically connected to a high voltage part of the secondary winding in the bottom, and a pulse generating capacitor and a discharge switch electrically connected to the primary winding of the pulse transformer. The discharge lamp connector is disposed so that the center thereof is located in a center line passing through a substantial center in an axis direction (a direction parallel to a center line) of the pulse transformer and perpendicular to the axis direction. The capacitor and the discharge switch are disposed to be opposed to the high voltage part of the secondary winding and a high voltage area including the inner-electrode terminal with the discharge lamp connector therebetween.

7 Claims, 15 Drawing Sheets

[Fig. 1]
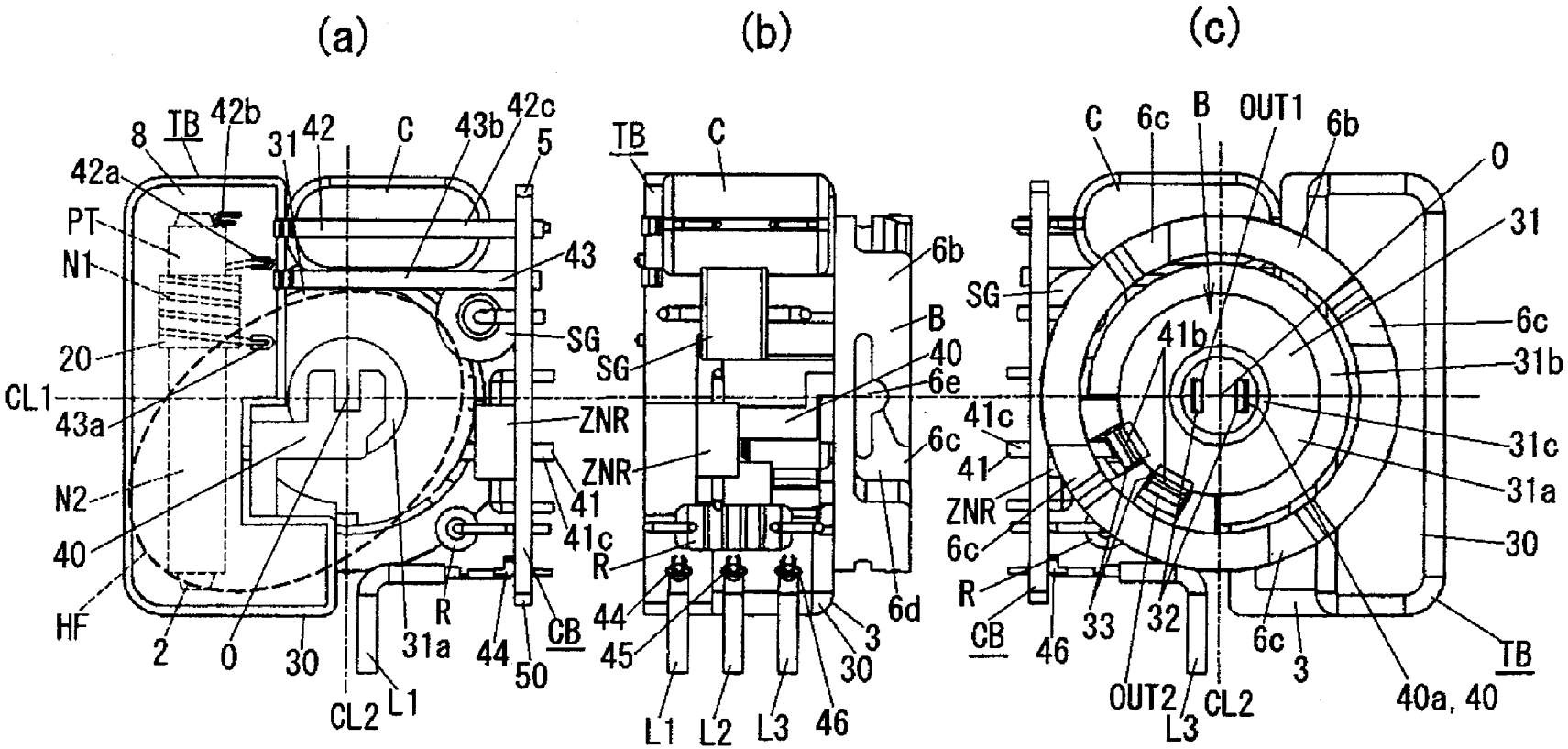

[Fig. 2]
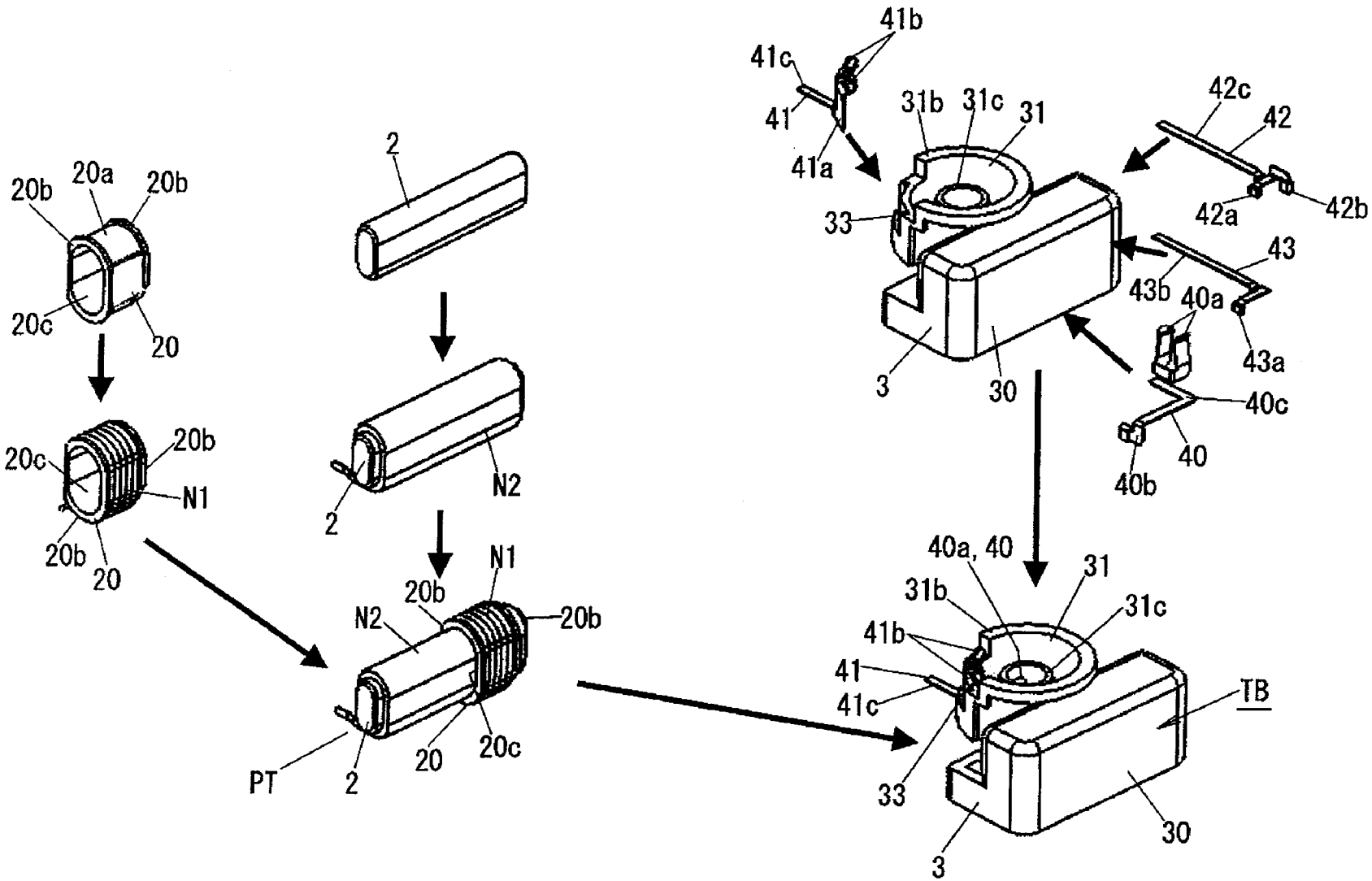

[Fig. 3]
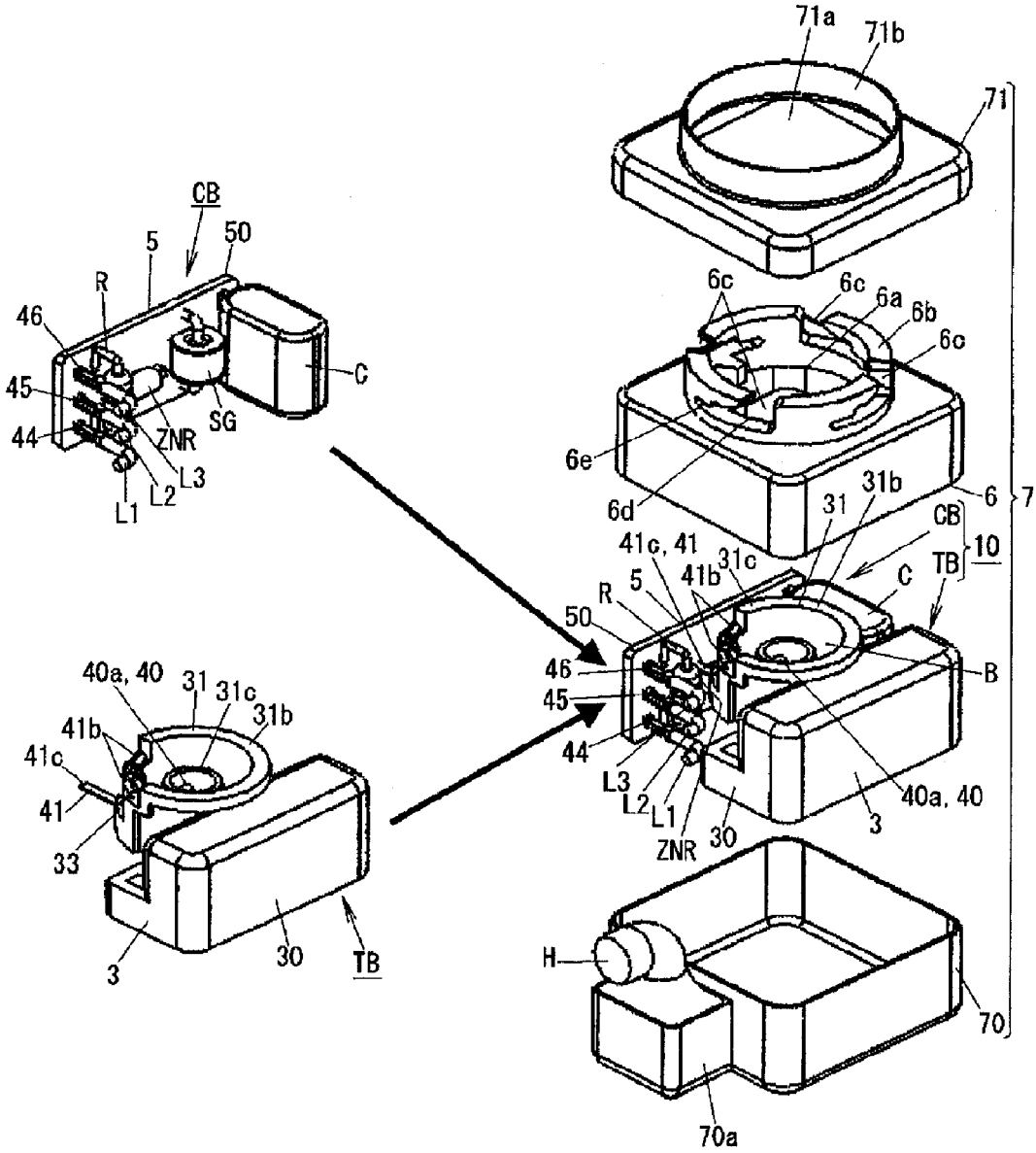

[Fig. 4]
(a)
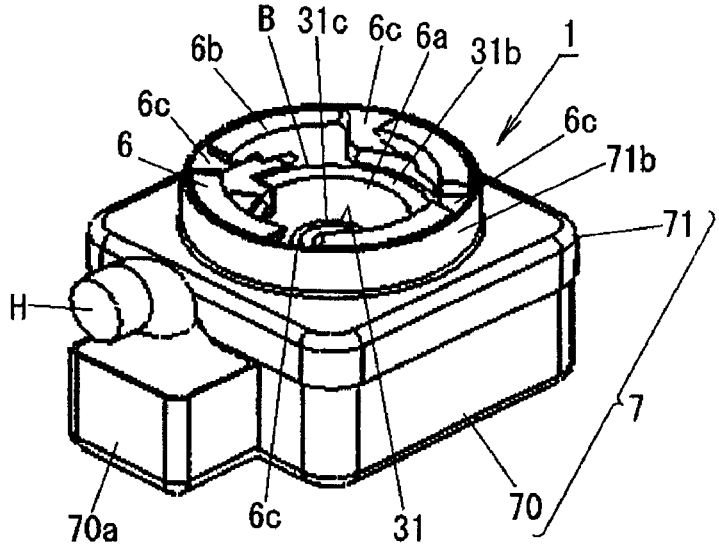
(b)
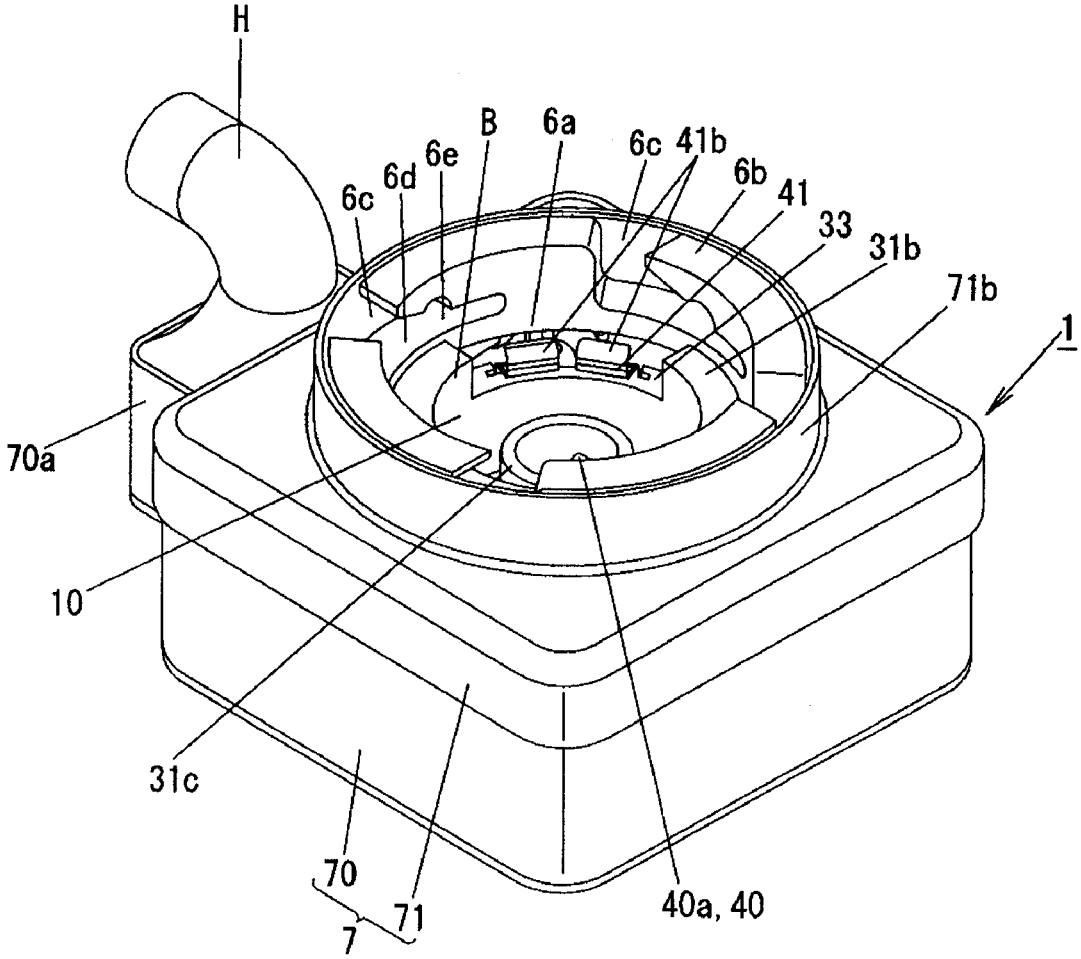

[Fig. 5]
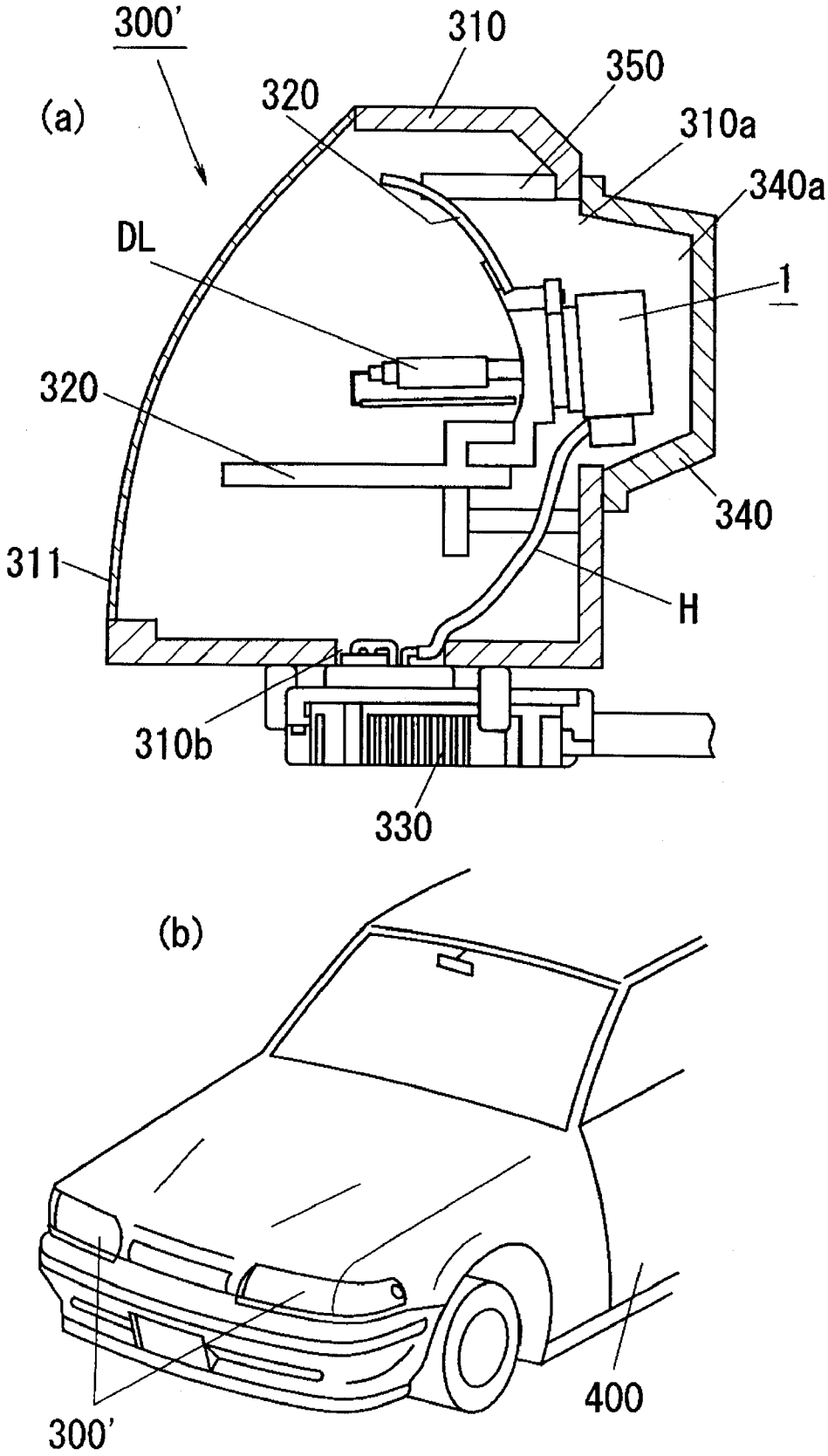

[Fig. 6]
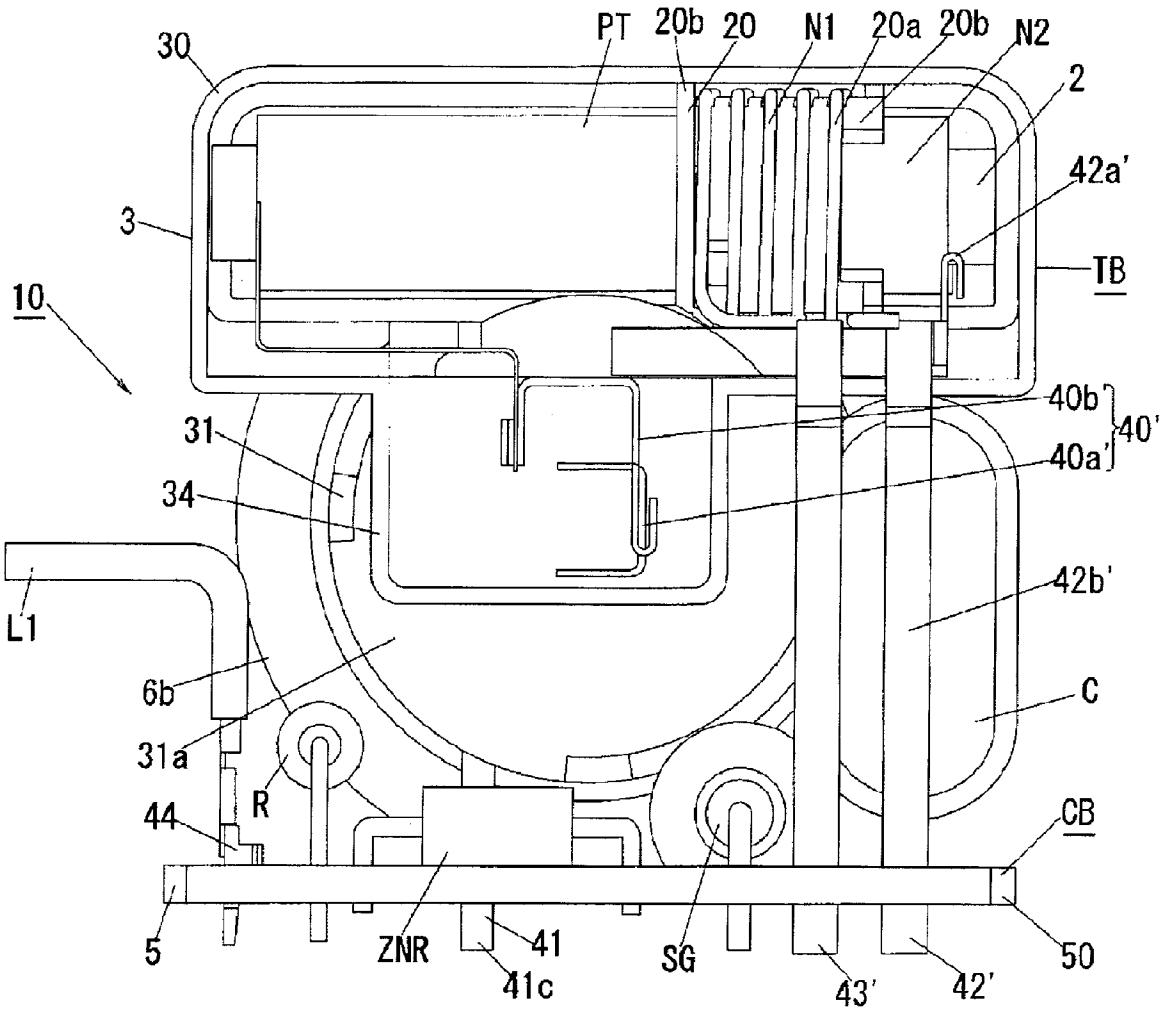

[Fig. 7]
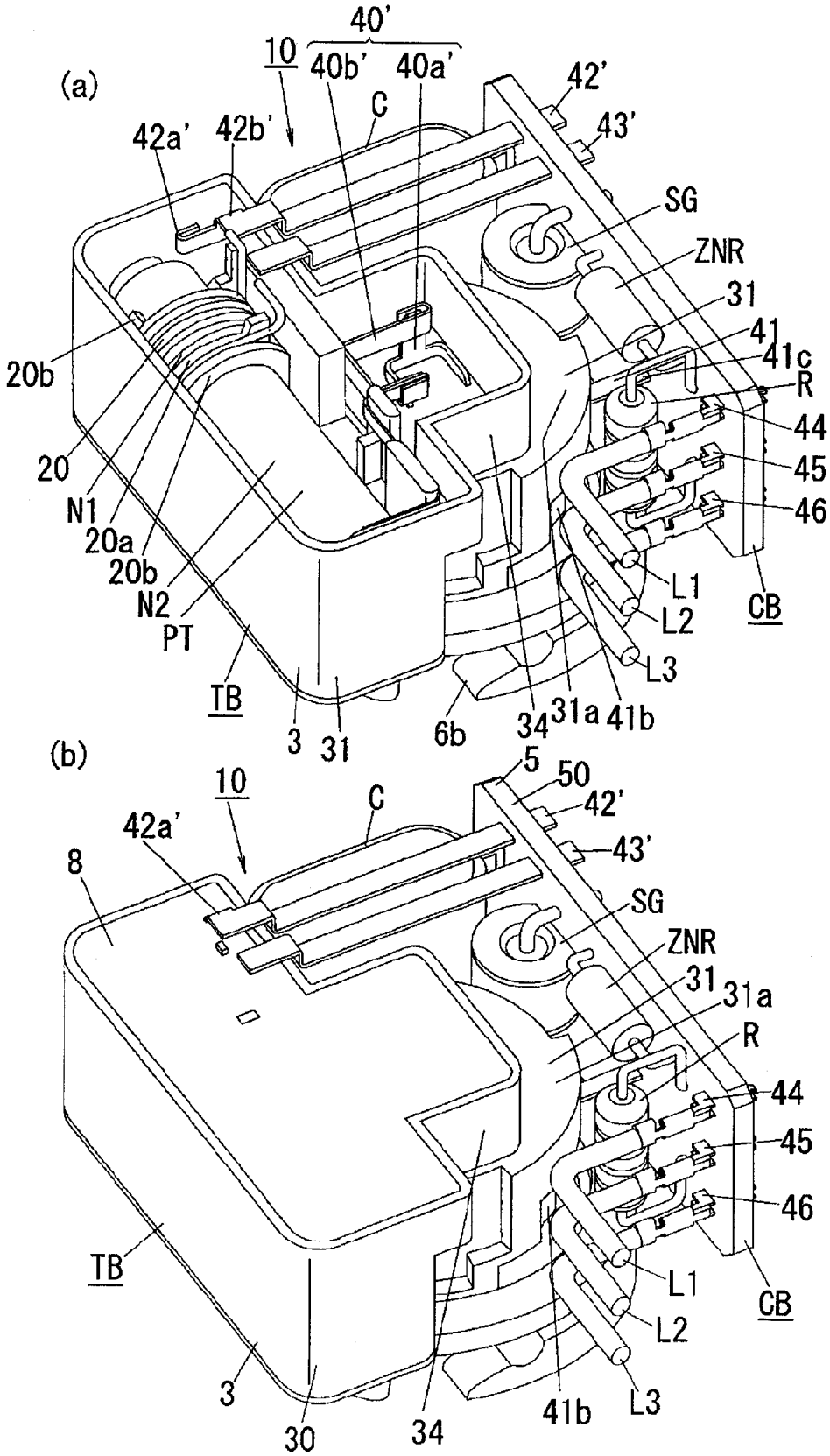

[Fig. 8]
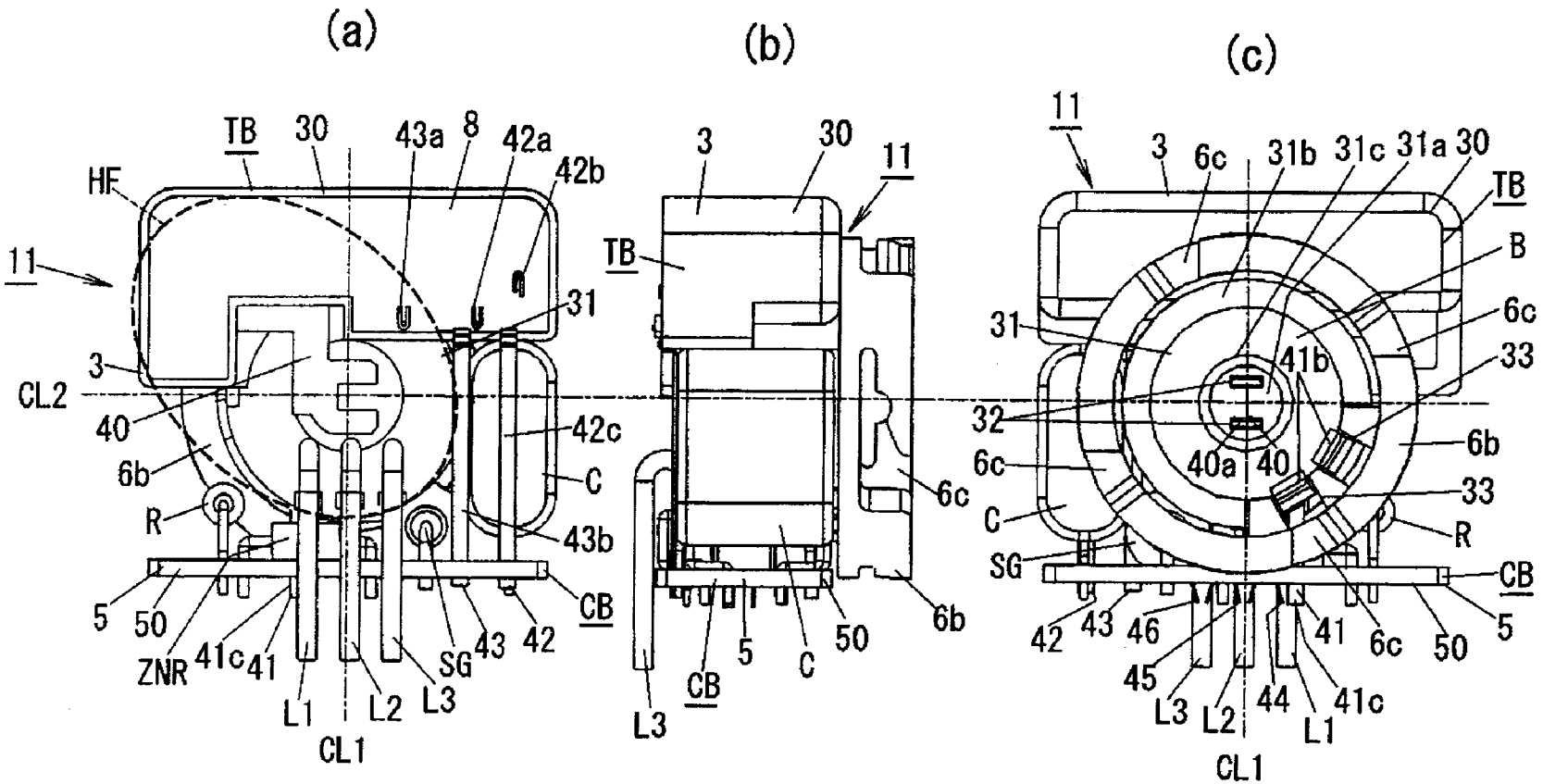

[Fig. 9]
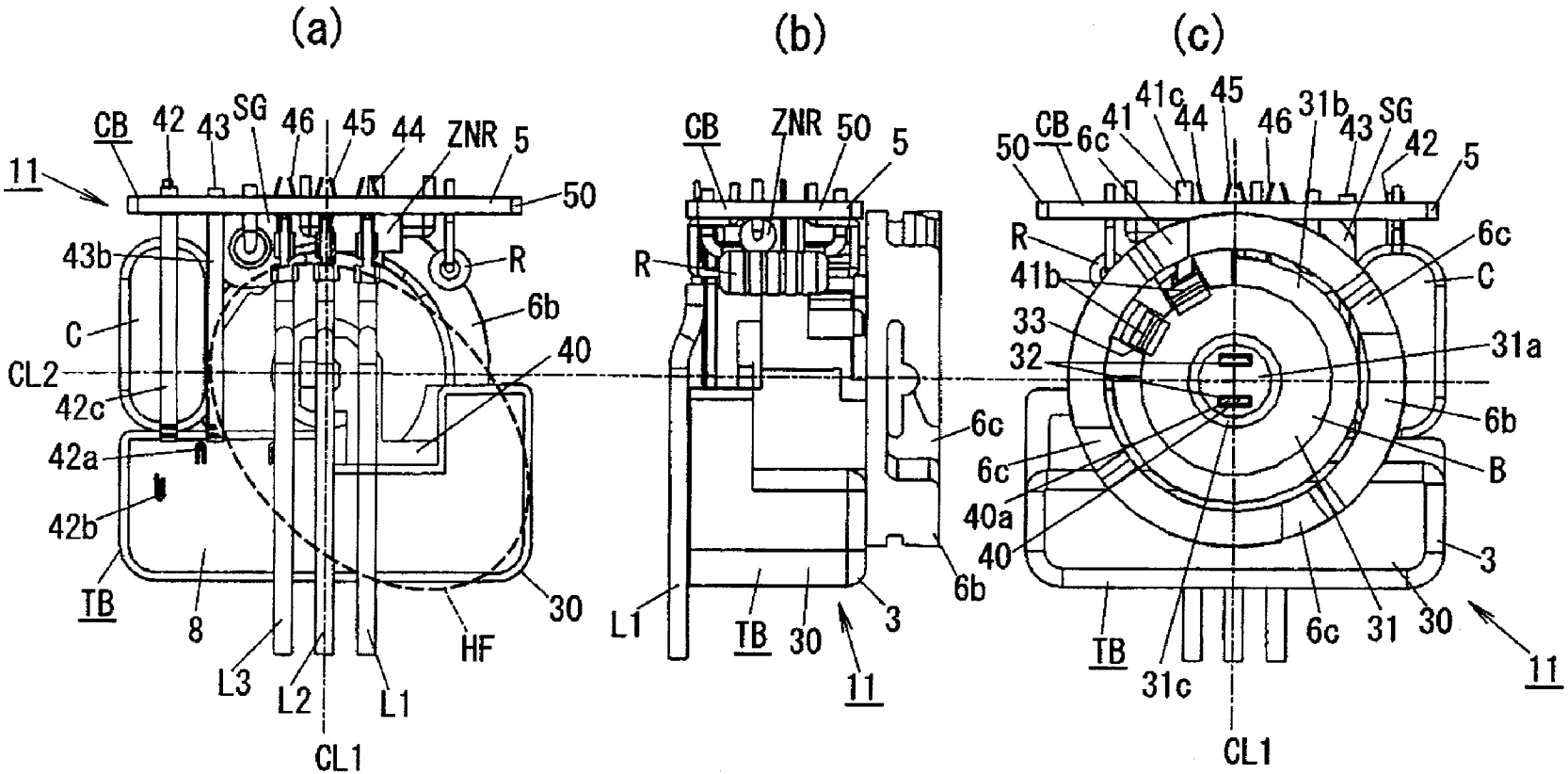

[Fig. 10]
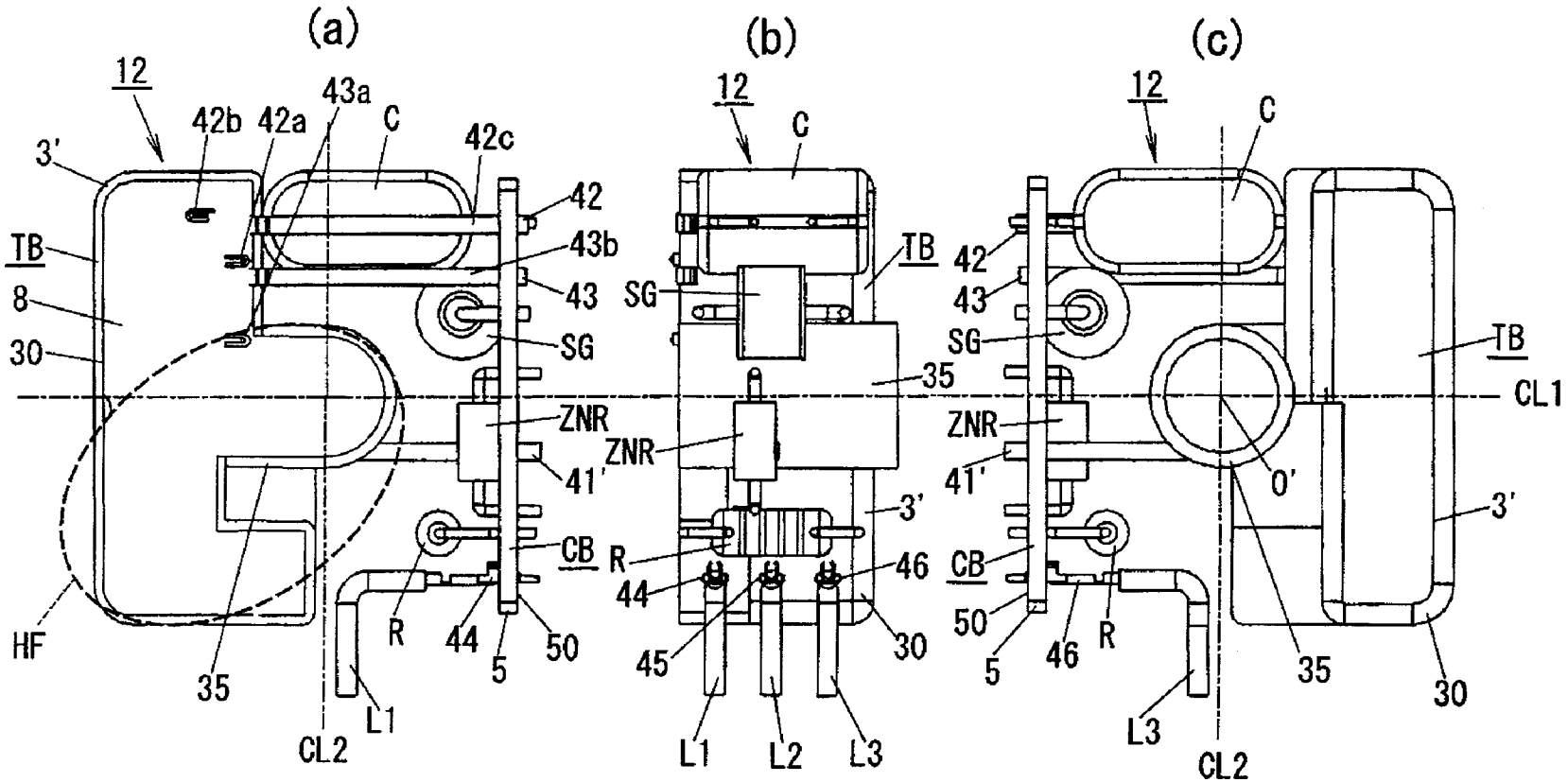

[Fig. 11]
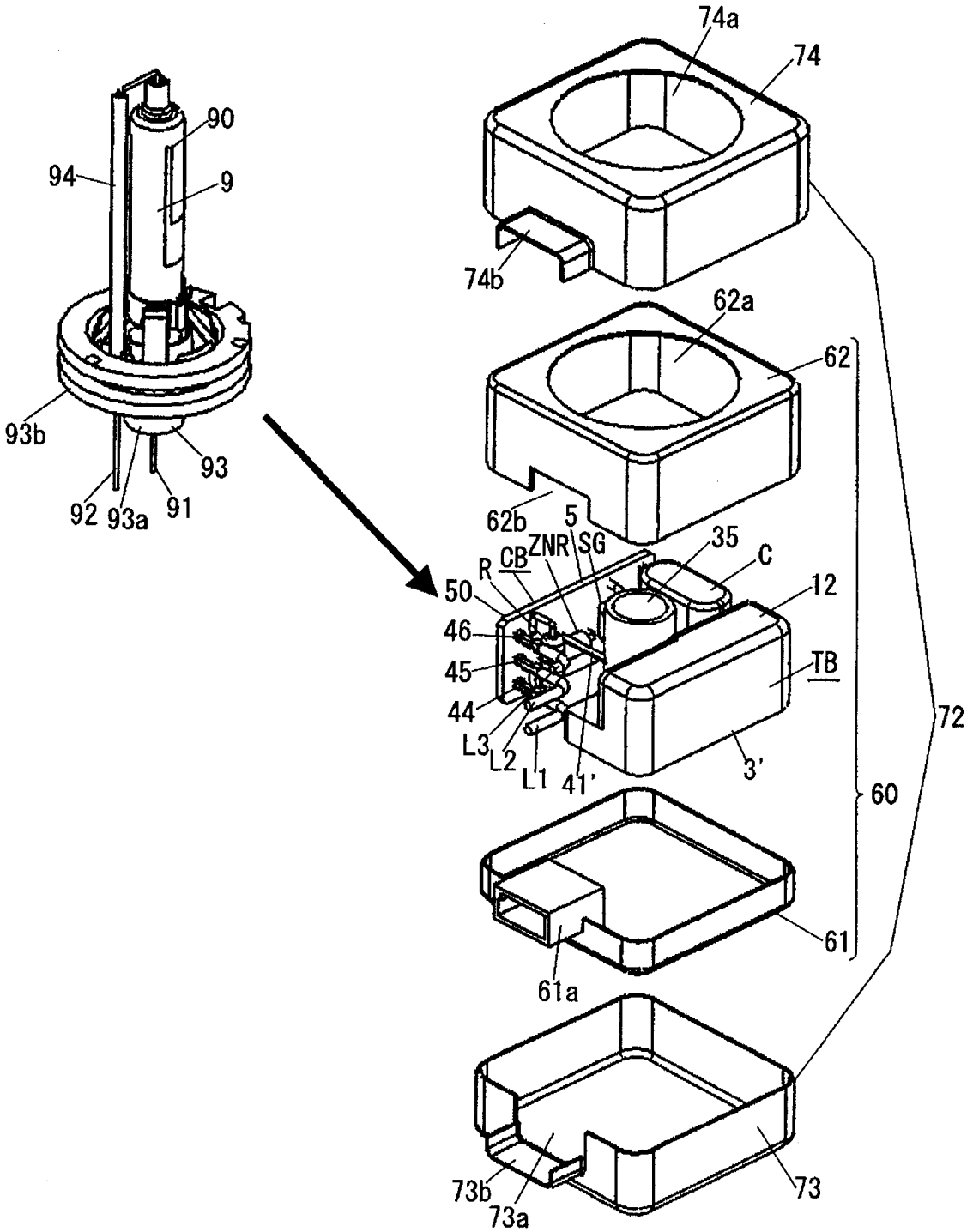

HIGH-VOLTAGE PULSE GENERATOR, AND LIGHTING APPARATUS AND VEHICLE HAVING THE SAME

TECHNICAL FIELD

The present invention relates to a high-voltage pulse generator used for starting up and re starting up a high-brightness discharge lamp such as a mercury lamp and a metal halide lamp, and a lighting apparatus and a vehicle employing the high-voltage pulse generator.

BACKGROUND ART

Conventionally, there were known lighting apparatuses for lighting a high-brightness discharge lamp (hereinafter, referred to as an HID lamp) such as a mercury lamp and a metal halide lamp. Such lighting apparatuses employ a high-voltage pulse generator (also referred to as a discharge lamp igniter) for instantaneously starting up or restarting up the HID lamp, in addition to an inverter for supplying power to the HID lamp.

As shown in FIG. 13, a high-voltage pulse generator 100 includes an IGN connector A having in put terminals IN1 to IN3 electrically connected to output terminals of an inverter and a socket B into which a cap E of an HID lamp DL is fitted. The high-voltage pulse generator 100 employs a pulse transformer (not shown) for converting a low-voltage pulse into a high-voltage pulse.

As shown in FIG. 14, such a high-voltage pulse generator 100 includes a pulse transformer PT in which a primary winding N1 and a secondary winding N2 are wound on a cylinder-shaped ferrite core 200, terminals 201 and 201 electrically connected to both ends of the first primary winding N1, respectively, a high-voltage part terminal 202 and a low-voltage part terminal 203 electrically connected to both ends of the secondary winding N2, respectively, an insert molded member 204 into which the pulse transformer PT and the terminals 201 to 203 are inserted with the terminals 201 to 203 exposed, and a case 206 into which the insert molded member 204 is inserted, on which electronic components 205 constituting the high-voltage pulse generator 100 along with the pulse transformer PT are mounted, and which includes a socket B having an inner electrode OUT1 and an outer electrode OUT2 connected to an inner electrode and an outer electrode of the cap E of the HID lamp DL (Patent Document 1).

A circuit configuration of the high-voltage pulse generator 100 is now described with reference to FIG. 15. As shown in FIG. 15, the high-voltage pulse generator 100 includes a high-voltage part input terminal IN1 and low-voltage part input terminals IN2 and IN3, which constitute the IGN connector A, electrically connected to the output terminals of the inverter, a pulse generating capacitor C connected between the input terminals IN1 and IN3, a surge absorber ZNR such as a two-way diode and a varistor connected between the input terminals IN1 and IN2, a resistor R connected in parallel to the capacitor C so as to discharge electric charges remaining in the capacitor C and the surge absorber ZNR, a pulse transformer PT having a primary winding N1 connected in parallel to the capacitor C and a secondary winding N2 disposed between the input terminal IN1 and the inner electrode OUT1 of the socket B, and a high-voltage pulse generating discharge switch (discharge gap) SG for switching a discharge path from the capacitor C to the primary winding N1. The input terminal IN2 is directly connected to the outer electrode OUT2 of the socket B. Accordingly, in the circuit of the high-voltage pulse generator 100, a portion denoted by reference numeral HV in FIG. 15 serves as a high-voltage part circuit and a portion denoted by a reference numeral LV serves as a low-voltage part circuit. Specifically, a loop circuit, which is denoted by a reference numeral P, including the capacitor C, the primary winding N1, and the discharge switch SG forms a pulse generator through which large current, that is, pulses flows in the low-voltage part circuit LV.

Next, an operation of the high-voltage pulse generator 100 is described. When an output of the inverter is input to the input terminals IN1 to IN3 of the high-voltage pulse generator 100, the capacitor C is charged by a potential difference between the input terminals IN1 and IN3. When the voltage of the capacitor C becomes greater than a predetermined value, the discharge switch SG is turned on and a pulse is applied to the primary winding N1. In this way, when the pulse is applied to the primary winding N1 of the pulse transformer PT, the pulse transformer PT outputs a high-voltage pulse out of the secondary winding N2. Accordingly, the high-voltage pulse is supplied from the inner electrode OUT1 to the HID lamp DL and thus the HID lamp DL is ignited or re-ignited.

The high-voltage pulse generator 100 described above is used to instantaneously ignite and re-ignite the HID lamp in a lighting apparatus for lighting a HID lamp such as a mercury lamp and a metal halide lamp. A vehicle headlight apparatus 300 shown in FIG. 16 is an example of such a lighting apparatus.

As shown in FIG. 16, the vehicle headlight apparatus 300 includes a box-shaped lamp housing 310, a reflecting plate 320 for reflecting light emitted from an HID lamp DL, a high-voltage pulse generator 100 into which the HID lamp DL is fitted, and an inverter 330 electrically connected to the high-voltage pulse generator 100 so as to convert a DC voltage supplied from a 12V battery (not shown) of a vehicle into an AC voltage for driving the HID lamp.

The lamp housing 310 is formed in a box shape of which the front surface (left surface in FIG. 16) is opened and is mounted with a front lens 311 to cover the opened front surface. In a rear wall of the lamp housing 310, a circular lamp inserting hole 310*a* for inserting the HID lamp DL into the lamp housing 310 is formed in a portion corresponding to the back of the HID lamp DL disposed in the lamp housing 310. A recessed portion 340*a* for receiving a part of the high-voltage generator 100 is formed in the circumferential edge of the lamp inserting hole 310*a*, and a lamp interchanging maintenance cap 340 for closing the lamp inserting hole 310*a* is attached to the recessed portion 340*a* to be detachable from the back side. In addition, a power line inserting hole 310*b* for introducing a power line such as a harness H having one end connected to the inverter 330 into the lamp housing 310 is formed in the lower wall of the lamp housing 310. A screw inserting hole (not shown) through which an optical axis adjusting screw 350 is inserted to pass through the rear wall is formed in the vicinity of the lamp inserting hole 310*a* formed in the rear wall of the lamp housing 310.

The reflecting plate 320 is vertically rotatably received in the lamp housing 310 in the state that the reflecting surface is directed to the front side. The reflecting plate 320 can adjust the optical axis of light of the HID lamp DL in the vertical direction by forwardly and backwardly moving the optical axis adjusting screw 350 inserted in the lamp housing 310 through the screw inserting hole. The inverter 330 is attached to the lower surface of the lamp housing 310 from the lower side so as to close the power line inserting hole 310*b* and the harness H having one end connected to the inverter 330 is introduced into the lamp housing 310 through the power line inserting hole 310*b*.

On the other hand, the high-voltage pulse generator 100 is disposed in the vicinity of the lamp inserting hole 310*a* of the lamp housing 310 in a state that the HID lamp DL is fitted into the socket B, the other end of the harness H is connected to the IGN connector A, the IGN connector A is directed upward, and the HID lamp DL is received in the lamp housing 310 through the lamp inserting hole 310*a*. The maintenance cap 340 is attached to the rear wall of the lamp housing 310 in the state that a part of the high-voltage pulse generator 100 is received in the recessed portion 340*a*.

[Patent Document 1] Japanese Patent Laid-open No. 2002-217050 (FIGS. 4, 12, and 16)

In recent years, decrease in size of such a vehicle headlight apparatus 300 was advanced, and thus decrease in size of the lamp inserting hole 310*a* has been required.

However, in the high-voltage pulse generator 100, since the socket B is disposed on the high voltage side of the secondary winding N2 of the pulse transformer PT, a distance between the center of the socket B and a portion farthest from the center in the case 206, that is, a radius of rotation is increased. Thus, when the lamp inserting hole 310*a* is formed small to correspond to the high-voltage pulse generator 100, the position of the HID lamp DL in the lamp housing 310 is inclined toward an edge of the lamp inserting hole 310*a*, thereby badly deteriorating workability to fit the HID lamp DL very much. On the contrary, when the position of the HID lamp DL is set in the vicinity of the center of the lamp inserting hole 310*a* in consideration of the workability to fit the HID lamp DL, the lamp inserting hole 310*a* should be enlarged in accordance with the radius of rotation of the high-voltage pulse generator 100. Accordingly, it is not possible to accomplish the decrease in size.

Such a problem could be solved by reducing the radius of rotation of the high-voltage pulse generator 100, that is, by disposing the socket B in the vicinity of the center of the case 206, but when the socket B is disposed in the vicinity of the center of the case 206, electronic components 205, . . . must be mounted on the case 206 avoiding and surrounding the socket B in the high-voltage pulse generator 100. As a result, the wiring distance between the electronic components 205, . . . is increased and a path through which pulses pass, that is, a large-current path, is elongated in the pulse generating section denoted by the letter P indicated in FIG. 15, thereby deteriorating the electrical characteristic. Since the high voltage of the secondary winding N2 may leak to the electronic components 205 mounted on the vicinity of the high voltage part of the secondary winding N2 of the pulse transformer PT, an additional insulating process should be performed to the electronic components 205, thereby increasing the manufacturing cost.

That is, in the conventional high-voltage pulse generator 100, when the radius of rotation is decreased in response to the requirement for decrease in size of the lighting apparatus, deterioration in performance due to the deterioration of electrical characteristic or increase in manufacturing cost may be newly caused.

DISCLOSURE OF INVENTION

Technical Problem

The present invention is contrived to solve the above-mentioned problems. An object of the invention is to provide a high-voltage pulse generator with a reduced radius of rotation and improved performance, and a lighting apparatus and a vehicle having the high-voltage pulse generator.

Technical Solution

According to a first aspect of the present invention, there is provided a high-voltage pulse generator comprising a pulse transformer in which a primary winding and a secondary winding are wound on a rod-shaped core, a discharge lamp connector which is made of an insulating material in a tube shape having an opened front surface out and which has therein an electrode electrically connected to a high voltage part of the secondary winding, and a pulse generating capacitor and a discharge switch electrically connected to the primary winding of the pulse transformer, wherein the discharge lamp connector is disposed so that the center thereof is located in a line passing through a substantial center in an axis direction of the pulse transformer and perpendicular to the axis direction, and the capacitor and the discharge switch are disposed to be opposed to the high voltage part of the secondary winding with the discharge lamp connector therebetween.

According to the configuration of the first aspect described above, since the discharge lamp connector is positioned in the line which passes through the substantial center in the axis direction of the pulse transformer and is perpendicular to the axis direction, the radius of rotation can be decreased. Since the pulse generating capacitor and the discharge switch are disposed to be opposed to the high voltage part of the secondary winding with the discharge lamp connector therebetween and to be spaced apart from the high voltage part of the secondary winding, it is possible to prevent the high voltage inducted by the secondary winding N2 from leaking to the low-voltage circuit such as the pulse generating capacitor or the discharge switch. Since the capacitor and the discharge switch are together disposed on the same side, the path through which the pulse passes is shortened. Consequently, it is possible to enhance the performance.

In the high-voltage pulse generator according to a second aspect of the invention, in addition to the configuration of the first aspect, an input portion for connection to a power line of an external power source is be disposed to be opposed to the pulse transformer with the discharge lamp connector therebetween.

According to the configuration of the second aspect, the pulse transformer which is a heavy component is disposed with good lateral balance when the input portion is disposed to face the low side. Consequently, it is possible to obtain a high-voltage pulse generator with good weight balance.

In the high-voltage pulse generator according to a third aspect of the invention, in addition to the configuration of the first aspect, an input portion for connection to a power line of an external power source is disposed to be opposed to the discharge lamp connector transformer with the pulse transformer therebetween.

According to the configuration of the third aspect, the pulse transformer which is a heavy component is disposed on the lower side with good lateral balance when the input portion is disposed to face the low side. Consequently, it is possible to obtain a high-voltage pulse generator with better weight balance in comparison with the second aspect.

In the high-voltage pulse generator according to a fourth aspect of the invention, in addition to the configuration of any one of the first to third aspects, the discharge lamp connector has a socket into which a cap of a discharge lamp is detachably fitted.

According to the configuration of the fourth aspect, the discharge lamp can be attached detachably.

In the high-voltage pulse generator according to a fifth aspect of the invention, in addition to the configuration of any one of the first to third aspects a discharge lamp is fifitted to the discharge lamp connector.

According to the configuration of the fifth aspect, since the discharge lamp is directly fixed, the elements such as a cap and a socket can be omitted. Consequently, it is possible to utilize large-scaled electronic components or to accomplish the decrease in size of the high-voltage pulse generator.

According to a sixth aspect of the invention, there is provided a lighting apparatus having the high-voltage pulse generator of any one of the first to fifth aspects.

According to the configuration of the sixth aspect, since the lighting apparatus has the high-voltage pulse generator with a small radius of rotation and an improved electrical characteristic, it is possible to provide a lighting apparatus with a small size and high performance.

According to a seventh aspect of the invention, there is provided a vehicle having the lighting apparatus of the sixth aspect According to the configuration of the seventh aspect, since the vehicle has the lighting apparatus with a small size and high performance, it is possible to increase the size of a cabin and thus to provide a vehicle with improved comfort.

DESCRIPTION OF DRAWINGS

FIG. 1(*a*) is a rear view partially illustrating a high-voltage pulse generator according to a first embodiment of the present invention, FIG. 1(*b*) is a lateral view partially illustrating the high-voltage pulse generator, and FIG. 1(*c*) is a front view partially illustrating the high-voltage pulse generator.

FIG. 2 is an assembly diagram illustrating a transformer section according to the first embodiment of the present invention.

FIG. 3 is an assembly diagram illustrating the high-voltage pulse generator according to the first embodiment of the present invention.

FIG. 4(*a*) is a perspective view illustrating the high-voltage pulse generator according to the first embodiment of the present invention and FIG. 4(*b*) is another perspective view thereof.

FIG. 5(*a*) is a cross-sectional view schematically illustrating a lighting apparatus employing the high-voltage pulse generator according to the first embodiment of the present invention and FIG. 5(*b*) is a perspective view partially illustrating a vehicle having the lighting apparatus according to the first embodiment of the present invention.

FIG. 6 is a rear view partially illustrating another example of the high-voltage pulse generator according to the first embodiment of the present invention.

FIG. 7(*a*) is a perspective view partially illustrating the high-voltage pulse generator according to the first embodiment of the present invention before filling it with resin and FIG. 7(*b*) is a perspective view partially illustrating the high-voltage pulse generator according to the first embodiment of the present invention after filling it with resin.

FIG. 8(*a*) is a rear view partially illustrating a high-voltage pulse generator according to a second embodiment of the present invention, FIG. 8(*b*) is a lateral view partially illustrating the high-voltage pulse generator, and FIG. 8(*c*) is a front view partially illustrating the high-voltage pulse generator.

FIG. 9(*a*) is a rear view partially illustrating another high-voltage pulse generator according to the second embodiment of the present invention, FIG. 9(*b*) is a lateral view partially illustrating the high-voltage pulse generator, and FIG. 9(*c*) is a front view partially illustrating the high-voltage pulse generator.

FIG. 10(*a*) is a rear view partially illustrating a high-voltage pulse generator according to a third embodiment of the present invention, FIG. 10(*b*) is a lateral view partially illustrating the high-voltage pulse generator, and FIG. 10(*c*) is a front view partially illustrating the high-voltage pulse generator.

FIG. 11 is an assembly diagram illustrating the high-voltage pulse generator.

BEST MODE

Figure 12:
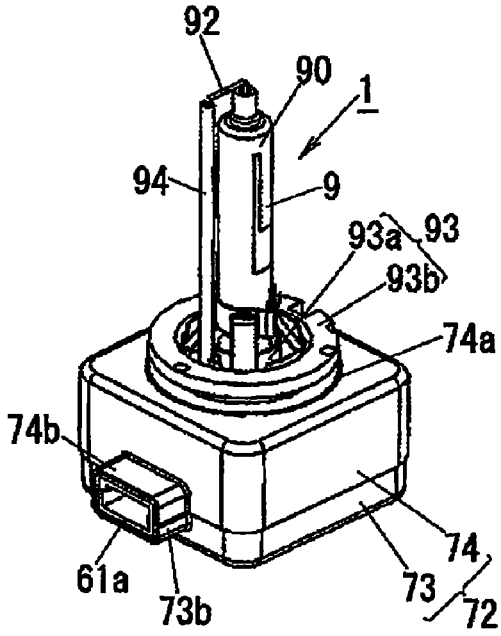
FIG. 12 is a perspective view illustrating the high-voltage pulse generator.
Figure 13:
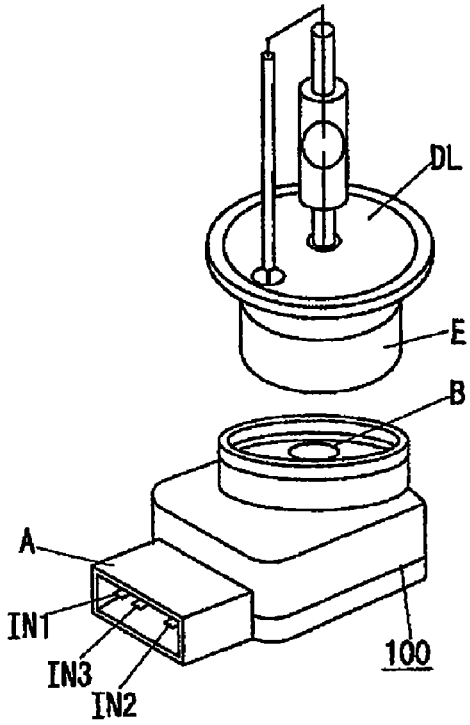
Prior Art Fig. 13
FIG. 13 is a perspective view illustrating a conventional high-voltage pulse generator.

Hereinafter, exemplary embodiments of the present invention will be described with reference to FIGS. 1 to 12.

First Embodiment

A high-voltage pulse generator 1 according to a first embodiment of the present invention (see FIG. 4), as shown in FIGS. 1(*a*) to 1(*c*), includes: a transformer section TB having a pulse transformer PT in which a primary winding N1 and a secondary winding N2 are wound on a core 2 and a discharge lamp connector 31 which is made of an insulating material in a tube shape having a bottom and an opened front surface (front side in FIG. 1(*c*)) and which has therein an inner electrode (center electrode) OUT1 electrically connected to a high voltage part of the secondary winding N2 in the low part 31*a*; and a circuit section CB having a pulse generating capacitor C and a discharge switch SG electrically connected to the primary winding N1 of the pulse transformer PT, and a wiring board 5 mounted with them, wherein a n internal apparatus block 10 including the transformer section TB and the circuit section CB is received in a shield case 7 along with a case body 6 which is a front cover of the internal apparatus block 10.

Figure 15:
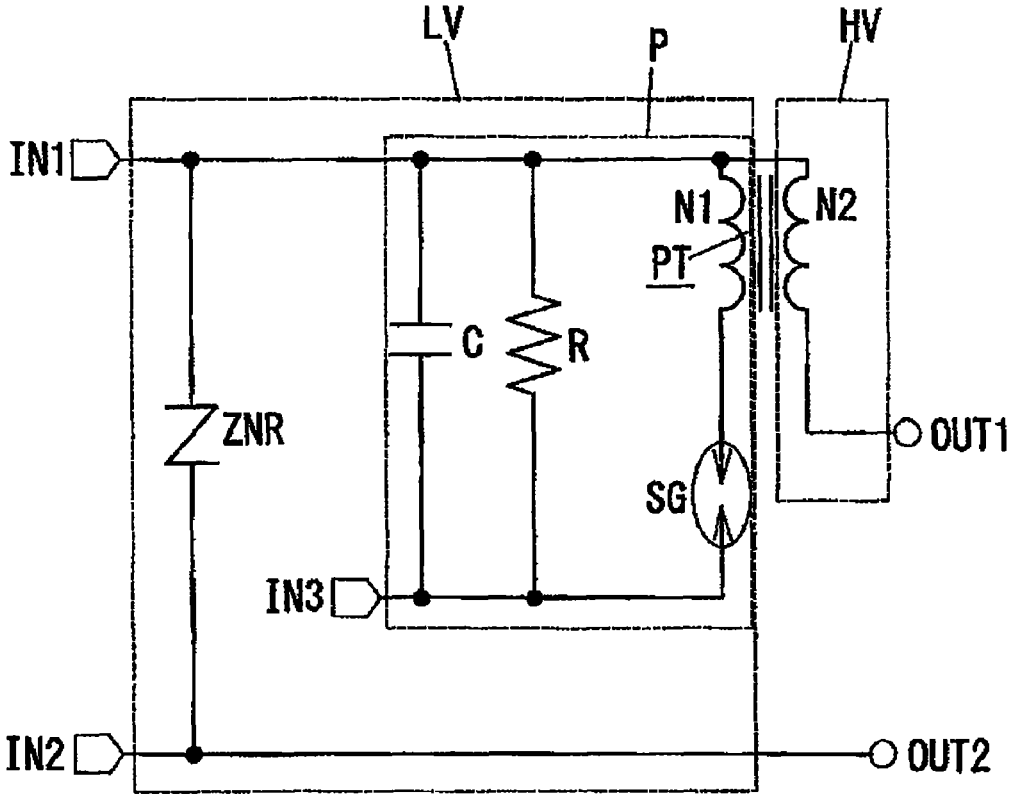
Prior Art Fig. 15
FIG. 15 is a circuit diagram illustrating the conventional high-voltage pulse generator.
Figure 16:
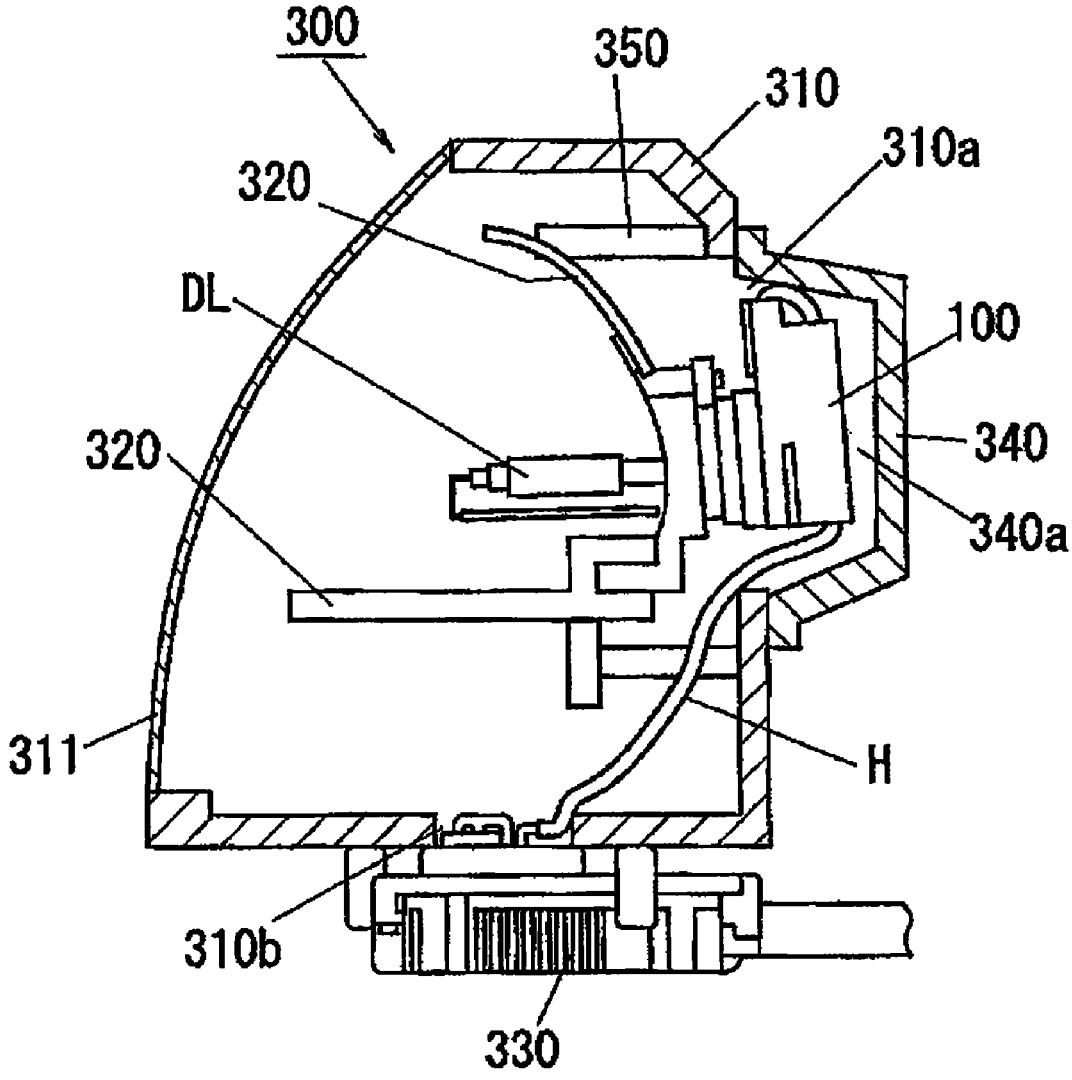
Prior Art Fig. 16
FIG. 16 is a cross-sectional view schematically illustrating a lighting apparatus employing the conventional high-voltage generator.

Since the circuit configuration of the high-voltage pulse generator 1 according to the first embodiment is similar to the conventional configuration shown in FIG. 15, like elements are denoted by like reference numerals and the description thereof is omitted. So long as a specific limitation is not mentioned, the side protruding from the paper in FIG. 1(*c*) is referred to as a front side of the high-voltage pulse generator 1, the upper side in FIG. 1C is referred to as an upper side of the high-voltage pulse generator 1, the lower side in FIG. 1C is referred to as a lower side of the high-voltage pulse generator 1, the right side in FIG. 1C is referred to as a right side of the high-voltage pulse generator 1, the left side in FIG. 1(*c*) is referred to as a left side of the high-voltage pulse generator 1, and the side entering the paper in FIG. 1C is referred to as a rear side of the high-voltage pulse generator 1.

The transformer section TB, as shown in FIG. 2, includes a pulse transformer PT and a resin case 3 for receiving the pulse transformer PT. The discharge lamp connector 31 is integrally formed with the resin case 3.

The pulse transformer PT, as shown in FIG. 2, includes a core 2, a secondary winding N2 wound on the core 2, a coil bobbin 20 fitted to surround the secondary winding N2 which is wound on the core 2 and disposed on the low voltage part of the secondary winding N2, and a primary winding N1 wound on the coil bobbin 20 which is fitted to surround the core 2.

Here, the core 2 is made of synthetic resin containing about 80 wt % of magnetic particles such as ferrite particles, for example, Ni—Zn ferrite particles and is formed in a rod shape having an elliptical section. The secondary winding N2 is a rectangular wire having a thin foil shape and is wound on the core 2 by the use of an edgewise winding method (a direction of winding the rectangular wire to be opposed to each other in the width direction).

The coil bobbin 20 is, for example, a resin molded member made of an insulating resin and integrally includes a cylinder-shaped hosting drum 20*a* on which the primary winding N1 is wound and flanges 20*b* and 20*b* formed at both ends of the host drum 20*a*. A hole 20*c* is axially formed in the coil bobbin 20 and the size of the hole 20*c* is set so as to allow the core 2 on which the secondary winding N2 is wound to pass through the hole 20*c*.

The resin case 3 is made of, for example, synthetic resin having a predetermined insulating property, for example, such as liquid crystal polymer and as shown in FIG. 1(*a*), integrally includes a reception part 30 for receiving the pulse transformer PT and the discharge lamp connector 31. Here, the discharge lamp connector 31 is disposed on one side (on the right side in FIG. 1(*a*)) of the reception part 30 so that the center O thereof is located in a center line CL1 passing through a substantial center in an axis direction (a direction parallel to a center line CL2) of the pulse transformer PT received in the reception part 30 and being perpendicular to the axis direction.

The reception part 30 is formed in a rectangular hexahedron shape of which the rear side (the front side in FIG. 1A) is opened and has a space for receiving the pulse transformer PT therein. When the pulse transformer PT is received in the reception part 30, the longitudinal center of the reception part 30 and the axial center of the pulse transformer PT are designed substantially to coincide with each other.

The discharge lamp connector 31 is formed in a tube shape having a bottom and an opened front surface (the front side in FIG. 1(*c*)). More specifically speaking, the discharge lamp connector 31 integrally includes a circular bottom 31*a* and a tube-shaped portion 31*b* protruding forwardly from the circumferential edge of the bottom 31*a* and has an inner diameter approximately equal to the outer diameter of a cap E of an HID lamp DL. A pair of rectangular holes 32 and 32 is formed through the bottom 31*a* and a rectangular recessed portion 33 is formed in the outer circumferential surface of the tube-shaped portion 31*b*. In addition, a tube-shaped inner wall 31*c* integrally protrudes from the bottom 31*a* so as to surround the pair of holes 32 and 32, thereby guaranteeing an insulation distance between the inner electrode OUT1 and the outer electrode OUT2 with the inner wall 31*c*.

On the other hand, an inner-electrode terminal 40 which is the inner electrode OUT1, an outer-electrode terminal 41 which is the outer electrode OUT2, and a first connection terminal 42 and a second connection terminal 43 for electrically connecting the pulse transformer PT to the wiring board 5 are disposed in the resin case 3.

The inner-electrode terminal 40 integrally has a pair of electrode terminal portions 40*a* and 40*a* opposed to each other, a caulking portion 40*b* to which the high-voltage end of the secondary wiring N2 is caulked and fixed, an approximately L-shaped connection 40*c* integrally connecting the base ends of the electrode terminals 40*a* and 40*a* to the caulking portion 40*b*, and is formed by bending a conductive metal plate.

The outer-electrode terminal 41 integrally has a horizontally longitudinal flat portion 41*a*, a pair of electrode terminal portions 41*b* and 41*b* extending forwardly from the front end of the flat portion 41*a*, and a circuit terminal 41*c* extending laterally from the rear end of the flat portion 41*a* and is formed by bending a conductive metal plate.

The first connection terminal 42 integrally has a primary-winding caulking portion 42*a* to which an end of the primary winding N1 is fixed in a caulking manner, a secondary-winding caulking portion 42*b* to which a low-voltage end of the secondary winding N2 is fixed in a caulking manner, and a longitudinal terminal portion 42*c* which has both caulking portions 42*a* and 42*b* at one end thereof and of which the other end is connected to the wiring board 5, and is formed by bending a conductive metal plate.

The second connection terminal 43 integrally has a primary-winding caulking portion 43*a* to which the other end of the primary winding N1 is fixed in a caulking manner and a longitudinal terminal portion 43*b* which has the caulking portion 43*a* at one end thereof and of which the other end is connected to the wiring board 5, and is formed by bending a conductive metal plate.

The terminals 40 to 43 are attached to the resin case 3 as follows.

The inner-electrode terminal 40 is attached to the rear surface of the resin case 3, in the state that a pair of electrode terminal portions 40*a* and 40*a* are protruded forwardly from the pair of holes 32 and 32 formed through the bottom 31*a* of the discharge lamp connector 31 and the caulking portion 40*b* is disposed on the high voltage side (the lower end in FIG. 1(*a*)) of the secondary winding N2 of the pulse transformer PT received in the reception part 30.

The outer-electrode terminal 41 is attached to the resin case 3 by inserting the flat portion 41*a* into the recessed portion 33 of the tube-shaped portion 31*b* of the discharge lamp connector 31 in the state that the electrode terminal portions 41*b* and 41*b* are placed in the tube-shaped portion 31*b*.

The first connection terminal 42 is attached to the resin case 3, in the state that both caulking portions 42*a* and 42*b* are disposed on the low voltage side (the upper side in FIG. 1(*a*)) of the secondary winding N2 of the pulse transformer PT received in the reception part 30 and the terminal portion 42*c* is protruded toward the discharge lamp connector 31 (to the right side in FIG. 1(*a*)) from the reception part 30.

The second connection terminal 43 is attached to the resin case 3 to be parallel to the first connection terminal 42, in the state that the caulking portion 43*a* is disposed on the low voltage side (the upper side in FIG. 1(*a*)) of the secondary winding N2 of the pulse transformer PT received in the reception part 30 and the terminal portion 43*b* is protruded toward the discharge lamp connector 31 (to the right side in FIG. 1(*a*)) from the reception part 30.

In this way, the terminals 40 to 42 are attached to the resin case 3 and the discharge lamp connector 31 to which the inner-electrode terminal 40 and the outer-electrode terminal 41 are attached serves as the socket B to which the HID lamp DL is detachably fitted. As shown in FIG. 1A, the pulse transformer PT is received in the resin case 3 in the stat that the high voltage side of the secondary winding N2 faces the downside and the coil bobbin 20 becomes close to two connection terminals 42 and 43. Both ends of the primary winding N1 wound on the coil bobbin 20 are fixed to the caulking portion 42*a* of the first connection terminal 42 and the caulking portion 43*a* of the second connection terminal 43 in the caulking manner, respectively. The low-voltage end of the secondary winding N2 wound on the core 2 is fixed to the caulking portion 42*b* of the first connection terminal 42 in the caulking manner, and the high-voltage end is fixed to the caulking portion 40*b* of the inner-electrode terminal 40 in the caulking manner. Thereafter, the reception part 30 is filled with insulating resin 8 such as epoxy resin to improve the insulating property of the pulse transformer PT.

In this way, the transformer section TB is constructed and the circuit section CB is then described. In the circuit diagram shown in FIG. 15, the circuit section SB includes circuit components other than the primary winding N1 of the pulse transformer PT in the low-voltage side circuit LV, that is, the pulse generating capacitor PT, the discharge switch SG, the surge absorber ZNR such as a varistor, the charge discharging resistor R, power supply terminals 44 to 46 which are formed in a band shape out of a conductive metal plate and to which the connection lines L1 to L3 of the harness H are connected, and the wiring board 5 on which the components are mounted.

In the wiring board 5, a printed pattern (not shown) for constituting the circuit shown in FIG. 15 is formed on a rectangular insulating substrate 50. Here, as shown in FIG. 1(*a*), the length in the longitudinal direction of the insulating substrate 50 is set substantially equal to the length in the longitudinal direction (the vertical direction in FIG. 1(*a*)) of the reception part 30 of the resin case 3 and the length in the lateral direction is set substantially equal to the thickness (the vertical size in FIG. 3) of the reception part 30 of the resin case 3. In FIG. 1(*b*) and FIG. 10(*b*), the wiring board 5 is omitted.

On one surface of the wiring substrate 5, the capacitor C is mounted at one end (the upper end in FIG. 1A) in the longitudinal direction and the discharge switch SG is mounted at the end in the longitudinal direction of the wiring board 5 to be close to the capacitor C and closer to the end. The surge absorber ZNR is mounted at the center in the longitudinal direction of the wiring board 5. The resistor R and the electrode terminals 44 to 46 are mounted at the other end in the longitudinal direction of the wiring board 5.

In the circuit section CB having the above-mentioned structure, as shown in FIG. 1(*a*), one surface of the wiring board 5 mounted with the circuit components such as the capacitor C is opposed to the reception part 30 with the discharge lamp connector 31 of the resin case 3 therebetween and one end in the longitudinal direction at which the capacitor C and the discharge switch SG are mounted is directed to the low voltage side of the secondary winding N2 of the pulse transformer PT. Accordingly, the pulse generating capacitor C and the discharge switch SG are disposed to be opposed to the high voltage area HF including the high voltage side of the secondary winding N2 of the pulse transformer PT and the inner-electrode terminal 40 with the discharge lamp connector therebetween. At this time, the wiring board 5 is disposed in a projection plane of the reception part 30 to the wiring board 5. The circuit section CB is attached to the transformer section TB by mounting the outer-electrode terminal 41 and the connection terminals 42 and 43 on the wiring board 5 by soldering or the like. Accordingly, an inner apparatus block 10 having the circuit configuration shown in FIG. 15 is obtained and the inner apparatus block 10 is formed in the square shape in which the vertical size and the horizontal size are substantially equal to each other, as shown in FIG. 1(*c*).

The inner apparatus block 10 obtained in this way is received in a shield case 7 for shielding the inner apparatus block 10 from electronic noises along with a case body 6 having a bayonet structure for fixing the HID lamp DL. Accordingly, the high-voltage pulse generator 1 shown in FIGS. 4A and 4B is completed.

As shown in FIG. 3, the case body 6 is formed in a box shape made of insulating resin in which the rear surface is opened and then is attached to the front side of the inner apparatus block 10. A circular hole 6*a* for exposing the discharge lamp connector 31 of the inner apparatus block 10 to the outside is formed through the front surface of the case body 6, and a circular circumferential wall 6*b* surrounding the hole 6*a* is protruded forwardly from the circumferential edge of the hole 6*a*. Notched portions 6*c* for fixing HID lamp DL are formed in the circumferential wall 6*b* to divide the circumferential wall 6*b* into four portions in the circumferential direction. Each notched portion 6*c* has a so-called bayonet structure having a substantial L shape including a guide portion 6*d* extending forwardly and backwardly of which the front end is opened and a fixing portion 6*e* formed to extend in the circumferential direction from the rear end of the guide portion 6*d* and to be perpendicular to the forward and backward direction, so as to correspond to each fixing pin (not shown) of the HID lamp DL. The circumferential wall 6*b* is shown in FIGS. 1, 6, 8, and 9, for the purpose of convenience of explanation.

As shown in FIG. 3, the shield case 7 includes a rear (back) shield 70 and a front shield 71 which are made of metal. The rear shield 70 is formed in an angular tube shape having a square-shaped bottom and a box-shaped connector case 70*a* of which the inside communicates with the rear shield 70 is integrally formed at the center of the lower surface which the power supply terminals 44 to 46 of the inner apparatus block 10 are disposed close to. The front surface of the connector case 70*a* is opened and the harness H is inserted into the rear shield 70 through the connector case 70*a* from the opened front surface. In this way, after the harness H is inserted and connected to the power supply terminals 44 to 46 of the inner apparatus block 10, the connector case 70*a* is filled with insulating resin or the like.

The front shield 71 is formed in a box shape of which the rear surface is opened, a circular hole 71*a* for externally protruding the circumferential wall 6*b* of the case body 6 is formed in the front surface, and a cylindrical tube-shaped portion 71*b* along the outer circumferential surface of the circumferential wall 6*b* of the case body 6, that is, having an inner diameter substantially equal to the outer diameter of the circumferential wall 6*b*, is integrally protruded from the circumferential edge of the hole 71*a*.

Here, the inner apparatus block 10 is received in the shield case 7 along with the case body 6 as follows. First, the inner apparatus block 10 is received in the rear shield 70 in the state that the socket B is directed forward and the connection lines L1 to L3 of the harness H inserted into the rear shield 70 through the connector case 70*a* are connected to the power supply terminals 44 to 46 of the inner apparatus block 10, respectively. Accordingly, the connector case 70*a* serves as an input portion for connection to power supply lines of an external power source. At this time, the connection lines L1 to L3 are drawn to the high voltage side of the secondary winding N2 of the pulse transformer PT. Thereafter, the case body 6 is attached to the front side of the inner apparatus block 10 and the front shield 71 is attached to the rear shield 70 in the state that the circumferential wall 6*b* of the case body 6 is directed to the outside through the hole 71*a*.

In this way, the inner apparatus block 10 is received in the shield case 7 along with the case body 6, thereby completing the high-voltage pulse generator 1 shown in FIGS. 4(*a*) and 4(*b*). Since the operation of the high-voltage pulse generator 1 is substantially similar to that of the conventional example, description thereof is omitted.

Figure 14:
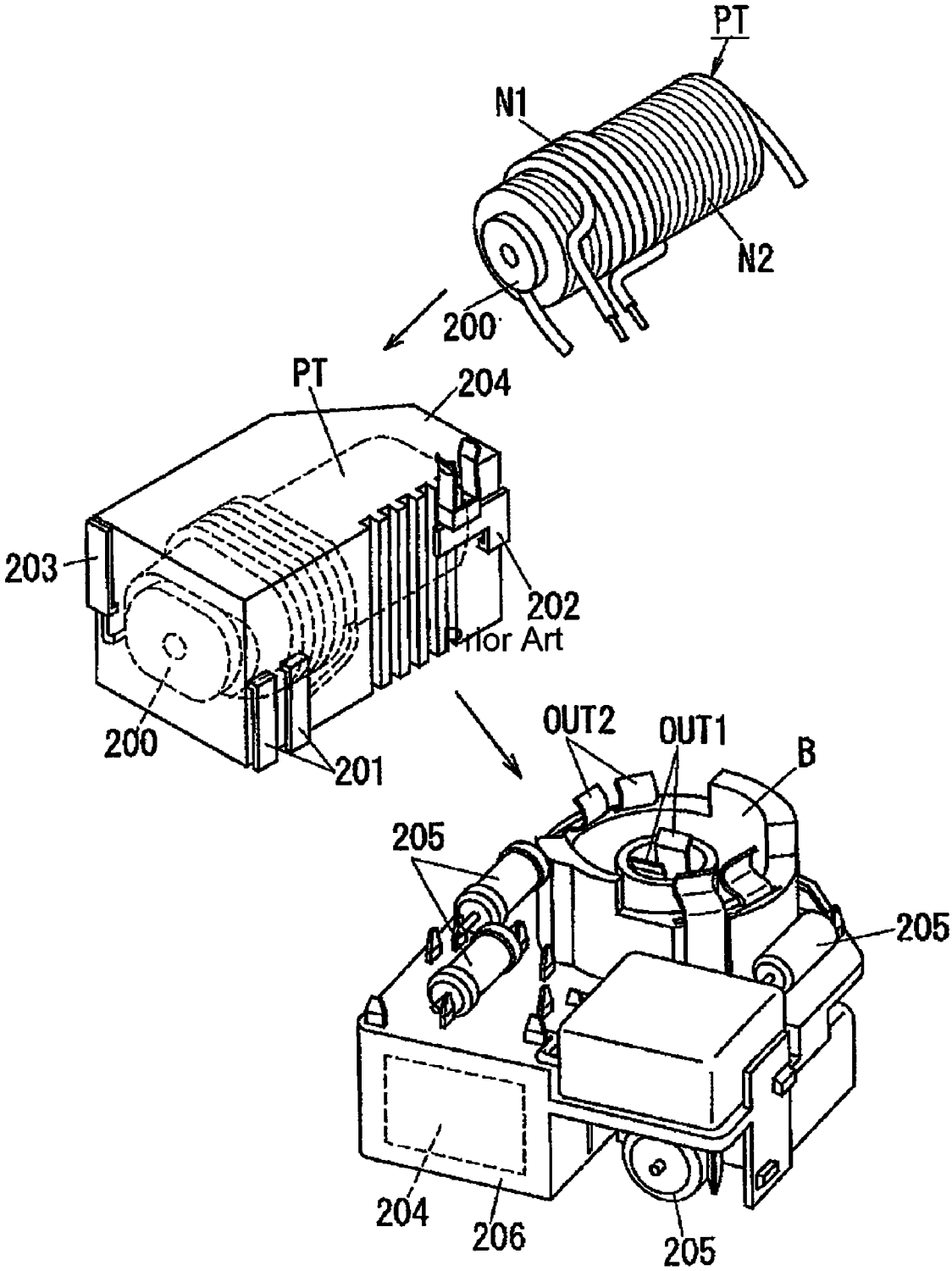
Prior Art Fig. 14
FIG. 14 is an assembly diagram illustrating the conventional high-voltage pulse generator.

According to the high-voltage pulse generator 1 according to the first embodiment described above, as shown in FIGS. 1(*a*) to 1(*c*), since the discharge lamp connector 31 constituting the socket B is disposed in the center line CL1 which passes through the center in the axis direction (the direction of the center line CL2) of the pulse transformer PT and is perpendicular to the axis direction, the distance between the center O of the discharge lamp connector 31 and the end of the resin case 3, that is, the radius of rotation, can be reduced smaller than that of the conventional example shown in FIG. 14. In addition, as shown in FIG. 5(*a*), when the high-voltage pulse generator is used in the vehicle headlight apparatus 300' and the size of the lamp inserting hole 310*a* is reduced to correspond to the high-voltage pulse generator 1, the installation position of the HID lamp DL in the lamp housing 310 is not inclined toward a side of the lamp inserting hole 310*a* thanks to the discharge lamp connector 31 having been disposed as described above, thereby not deteriorating the workability of fitting the HID lamp DL.

As shown in FIG. 1(*a*), since the pulse generating capacitor C and the discharge switch SG are disposed to be opposed to the high voltage area HF including the high voltage side of the secondary winding N2 of the pulse transformer PT and the inner-electrode terminal 40 with the discharge lamp connector 31 therebetween (that is, disposed on the opposite side about the center line CL1) and is spaced apart from the high voltage area HF, it is possible to prevent the high voltage from leaking to the low-voltage side circuit LV such as the pulse generating capacitor C and the discharge switch SG without performing an additional insulating process to the capacitor C and the discharge switch SG. Since the circuit components (such as the surge absorber ZNR and the resistor R) of the low-voltage side circuit LV are not disposed in the high voltage area HF, the same advantages can be obtained.

In addition, by together mounting the pulse generating capacitor C and the discharge switch SG at one end in the longitudinal direction of the wiring board 5 and directing the end in the longitudinal direction of the wiring board 5 to the low voltage side of the secondary winding N2 of the pulse transformer PT, the capacitor C and the discharge switch SG are disposed close to the primary winding N1 of the pulse transformer PT. Accordingly, the pulse generating section P is wired as short as possible. That is, since the wiring length of the pulse generating section P, that is, the path through which the pulses pass (large-current path), is reduced, it is possible to improve the electrical characteristic of the high-voltage pulse generator 1, thereby enhancing the performance of the high-voltage pulse generator 1.

As described above, the high-voltage pulse generator 1 according to the first embodiment can be used in a vehicle headlight apparatus 300' shown in FIG. 5(*a*). By using the high-voltage pulse generator 1 according to the first embodiment, the lamp inserting hole 310*a* can be reduced without deteriorating the workability of fitting the HID lamp and the electrical characteristic of the high-voltage pulse generator, unlike the conventional example. Accordingly, it is possible to obtain a vehicle headlight apparatus 300' with a small size and high performance.

Therefore, according to the vehicle headlight apparatus 300' employing the high-voltage pulse generator 1 according to the first embodiment, the decrease in size can be accomplished without problem. Accordingly, when the vehicle headlight apparatus 300' is used in a vehicle 400 shown in FIG. 5(*b*), the whole size of the vehicle 400 can be decreased or the size of the cabin (sitting room) can be increased by a reduced space for the vehicle headlight apparatus 300', thereby improving a comfort at the time of riding.

The high-voltage pulse generator 1 according to the first embodiment can be used in a vehicle assistant lighting apparatus or other lighting apparatus, in addition to the vehicle headlight apparatus 300' described above.

On the other hand, in the high-voltage pulse generator 1, as shown in FIG. 1A, the inner-electrode terminal 40 is exposed externally, but in view of safety, a circumferential wall 34 surrounding the inner-electrode terminal may be formed in the resin case 3, as shown in FIGS. 6 and 7.

For example, as shown in FIG. 7(*a*), the circumferential wall 34 integrally protrudes from the rear surface of the bottom 31*a* of the discharge lamp connector 31 so as to surround the inner-electrode terminal 40' and the circumferential wall 34 communicates with the reception part 30.

In the examples shown in FIGS. 6 and 7, the inner-electrode terminal 40', the first connection terminal 42', and the second connection terminal 43' have the same functions as the inner-electrode terminal 40, the first connection terminal 42, and the second connection terminal 43 shown in FIG. 1, but are different in structure therefrom. The different structures are described below. The inner-electrode terminal 40' integrally includes a '⊐-shaped' terminal portion 40*a'* having a pair of electrode terminals (not shown) and a '⊐-shaped' caulking portion 40*b'* in which the high voltage end of the secondary winding N2 is fixed to one end thereof in the caulking manner and the terminal portion 40*a'* is fixed to the other end in the caulking manner. The terminal portion 40*a'* and the caulking portion 40*b'* are formed, respectively, by bending conductive metal plates.

The first connection terminal 42' integrally includes a secondary-winding caulking portion 42*a'* to which the low voltage end of the secondary winding N2 is fixed in the caulking manner and a longitudinal terminal portion 42*b'* of which one end has a caulking portion 42*a'* and the other end is mounted on the wiring board 5. The first connection terminal 42' is formed by bending a conductive metal plate and one end of the primary winding N1 is fixed to one end of the first connection terminal 42' by soldering or the like.

The second connection terminal 43' is formed in a longitudinal shape out of a conductive metal plate. The other end of the primary winding N1 is fixed to one end of the second connection terminal 43' by soldering or the like and the other end of the second connection terminal 43' is mounted on the wiring board 5.

The pulse transformer PT is received in the resin case 3 having the circumferential wall 34, the inner-electrode terminal 40', and the connection terminals 42' and 43' in the state that the high voltage side of the secondary winding N2 is directed to the lower side and the coil bobbin 20 becomes close to both connection terminals 42' and 43', as shown in FIG. 7(*a*). Both ends of the primary winding N1 wound on the coil bobbin 20 is fixed to the ends of the connection terminals 42' and 43', respectively. The low-voltage end of the secondary winding N2 wound on the core 2 is fixed to the caulking portion 42*a'* of the first connection terminal 42' in the caulking manner and the high voltage end is fixed to the caulking portion 40*b'* of the inner-electrode terminal 40' in the caulking manner. Thereafter, the insulating resin 8 such as epoxy resin is filled in the reception part 30 and the inside of the circumferential wall 34, as shown in FIG. 7(*b*).

Therefore, according to the high-voltage pulse generator 1 shown in FIGS. 6 and 7, it is possible to improve the insulating property of the inner-electrode terminal 40' which is supplied with a high-voltage.

Although the connecting lines L1 to L3 of the harness H are directly connected to the power supply terminals 44 to 46 of the wiring board 5 in the high-voltage pulse generator, a connector may be constructed so that the harness H is detachably connected to the connector case by the use of pin-shaped terminals instead of the connecting lines L1 to L3. This is true of second and third embodiments to be described later.

Mode for Invention

Second Embodiment

When the high-voltage pulse generator is used in the vehicle headlight apparatus 300' shown in FIG. 5(*a*), the connector case 70*a* of the high-voltage pulse generator 1 from which the harness H is drawn may be disposed at the lower side so as not to elongate the harness H for connection to the inverter 330.

However, in the high-voltage pulse generator 1 according to the first embodiment, the connector case 70*a* which serves as the input portion for connection to the power line (harness) of an external power source is disposed on the high voltage side of the secondary winding N2 of the pulse transformer PT, as shown in FIG. 3. Accordingly, as shown in FIG. 5A, when the high-voltage pulse generator is fitted to the vehicle headlight apparatus 300', the pulse transformer PT which is a relatively heavy component is disposed at the right side. For this reason, the lateral weight balance of the high-voltage pulse generator 1 becomes much worse and the high-voltage pulse generator 1 tends to rotate about the HID lamp DL so as to move the pulse transformer PT, thereby imposing an unnecessary load to the HID lamp DL.

Therefore, in the high-voltage pulse generator according to the second embodiment, as shown in FIG. 8(*c*), the power supply terminals 44 to 46 are disposed on the rear side (the left side in FIG. 8(*b*)) of the center in the longitudinal direction of the wiring board 5 on one surface of the wiring board 5 opposed to the resin case 3 and when the inner apparatus block 11 is received in the shield case 7, the connector case 70*a* of the shield case 7 is opposed to the pulse transformer PT with the discharge lamp connector 31 therebetween (that is, the connector case 70*a* is located on the opposite side of the pulse transformer PT about the center line CL2). At this time, the connection lines L1 to L3 of the harness H connected to the power supply lines 44 to 46 are drawn toward the wiring board 5 (to the lower side in FIG. 8A) along the center line CL1 and then are drawn out to the outside, as shown in FIGS. 8(*a*) to 8(*c*). Since the other configuration is substantially similar to that of the first embodiment, like elements are denoted by like reference numerals and description thereof is omitted.

Therefore, according to the high-voltage pulse generator according to the second embodiment, when the high-voltage pulse generator is disposed with the connector case 70*a* directed downward, as shown in FIGS. 8(*a*) to 8(*c*), the pulse transformer PT which is a heavy component is located above the high-voltage pulse generator 1 in the state that the axis direction is parallel to the lateral direction. Accordingly, the pulse transformer PT is disposed with excellent lateral balance, thereby obtaining a high-voltage pulse generator with excellent weight balance.

On the other hand, the high-voltage pulse generator according to the second embodiment is not limited to that shown in FIG. 8, but the connector case 70*a* may be opposed to the discharge lamp connector 31 with the pulse transformer PT (that is, the connector case 70*a* may be located on the same side as the pulse transformer PT about the center line CL2), when the inner apparatus block 11 is received in the shield case 7. At this time, the connection lines L1 to L3 of the harness H connected to the power supply terminals 44 to 46 are drawn out toward the pulse transformer PT (to the lower side in FIG. 9(*a*)) along the center line CL1 and are drawn to the outside from the connector case 70*a*, as shown in FIGS. 9(*a*) to 9(*c*).

Therefore, according to the high-voltage pulse generator shown in FIG. 9, when the high-voltage pulse generator is disposed with the connector case 70*a* directed downward, as shown in FIGS. 9(*a*) to 9(*c*), the pulse transformer PT which is a heavy component is located below the high-voltage pulse generator 1 in the state that the axis direction is parallel to the lateral direction. Accordingly, the pulse transformer PT is disposed with excellent lateral balance, thereby obtaining a high-voltage pulse generator with excellent weight balance. Unlike the high-voltage pulse generator shown in FIG. 8, since the pulse transformer PT is disposed on the lower side, the weight balance can be further improved in comparison with that shown in FIG. 8.

Although it has been shown in FIGS. 8 and 9 that a part of the connection lines L1 to L3 are included in the high voltage area HF, the connection lines L1 to L3 may be detoured so as not to enter the high voltage HF.

Third Embodiment

In the high-voltage pulse generator 1 according to the first embodiment, the socket B which is detachably fitted with the HID lamp DL is constructed by the discharge lamp connector 31 to cope with the HID lamp DL having the cap E. However, a high-voltage pulse generator 1' according to a third embodiment is designed to cope with an HID lamp (hereinafter, referred to as a burner) 9 not having a cap and includes a discharge lamp connection 35 to which the burner 9 is fixed by welding or the like. The elements similar to those of the high-voltage pulse generator 1 according to the first embodiment are denoted by the same reference numerals and description thereof is omitted.

First, the burner 9 is described. The burner 9 may be a mercury lamp or a metal halide lamp and is a so-called cantilever type discharge lamp including a light emitting tube 90, a pair of electrodes 91 and 92 disposed apart from each other in the light emitting tube 90, and a cylindrical tube-shaped support 93 to which the rear end of the light emitting tube 90.

The light emitting tube 90 may be made of quartz glass and a spherical discharging space in which mercury, halogen gas, or inert gas is enclosed is formed at the center thereof. The electrodes 91 and 92 are formed in a longitudinal rod shape out of, for example, tungsten and are fitted to the light emitting tube 90 so that one end thereof is protruded into the light emitting tube 90 and the other end is protruded externally from the light emitting tube 90. Both electrodes 91 and 92 are disposed so that the ends are spaced apart from each other with a predetermined gap in the discharging space of the light emitting tube 90. The electrodes 91 and 92 and the light emitting tube 90 are air-tightly sealed.

The support 93 includes a substantially cylinder-shaped base 93*a* in which the light emitting tube 90 is fixed to the front end and the other end of the electrode 91 protruded from the light emitting tube 90 is inserted into the rear end to be protruded from the rear end, and a ring-shaped flange portion 93*b* surrounding the front end of the base 93*a*. The electrode 92 protruded from the light emitting tube 90 is drawn out to be protruded from the rear end of the base 93*a* through the base 93*a* and the flange portion 93*b* and is protected by a protection tube 94.

Similarly to the known discharge lamp, in the burner 9 having the above-mentioned structure, for example, when a predetermined voltage (breakdown voltage) is applied across the pair of electrodes 91 and 92, dielectric breakdown occurs in the discharging space of the light emitting tube 90 to start discharge, the sealed mercury is vaporized, and thus light is emitted by plasma discharge of the high-pressure mercury gas.

Next, the high-voltage pulse generator 1' according to the third embodiment is described with reference to FIGS. 10 to 12. The high-voltage pulse generator 1' according to the third embodiment (see FIG. 12), as shown in FIGS. 10A to 10C, includes a transformer section TB having a pulse transformer PT and a discharge lamp connector 35 which is formed in a tube shape having an opened front surface (the front side in FIG. 10C) out of an insulating material and which has an inner-electrode terminal (not shown) electrically connected to the high voltage side of the secondary winding N2 therein, and a circuit section CB. An inner apparatus block 12 including the transformer section TB and the circuit section CB is received in a protection case 60 and a shield case 72. The circuit configuration of the high-voltage pulse generator 1' according to the third embodiment is similar to that according to the first embodiment.

As shown in FIG. 10, the transformer section TB includes a pulse transformer PT and a resin case 3' for receiving the pulse transformer PT. The discharge lamp connector 35 is integrally formed in the resin case 3'.

The resin case 3' is made of synthetic resin having a predetermined insulating property such as liquid crystal polymer and as shown in FIG. 10A, integrally includes a reception part 30 for receiving the pulse transformer PT and the discharge lamp connector 35. Here, the discharge lamp connector 35 is disposed on one side (on the right side in FIG. 10(*a*)) of the reception part 30 so that the center O' thereof is located in a center line CL1 passing through a substantial center in an axis direction (a direction parallel to a center line CL2) of the pulse transformer PT received in the reception part 30 and being perpendicular to the axis direction.

The discharge lamp connector 35 is formed in a cylindrical tube shape and as shown in FIG. 10(*a*), the reception part 30 communicates with the inside the discharge lamp connector 35 at the rear end thereof. The discharge lamp connector 35 has an inner diameter substantially equal to the outer diameter of the base 93*a* of the burner 9 and the burner can be fixed to the discharge lamp connector 35 by inserting the base 93*a* of the burner 9 into the discharge lamp connector 35.

On the other hand, the resin case 3' is provided with an inner-electrode terminal (not shown) electrically connected to the electrodes 91 and 92 of the burner 9 by soldering (welding) or the like, outer-electrode terminals 41', and connection terminals 42 and 43.

The inner-electrode terminal is formed in a band shape out of a conductive metal plate and is disposed in the resin case 3' so that a portion welded to the electrode 91 of the burner 9 is protruded into the discharge lamp connector 35 so as to electrically connect the electrode 91 of the burner 9 to the high voltage end of the secondary winding N2.

The outer-electrode terminal 41' is formed in a band shape out of a conductive metal plate and is disposed in the resin case 3' so that one end thereof is buried in the discharge lamp connector 35 and the other end is protruded from the discharge lamp connector 35 to the wiring board 5 so as to electrically connect the electrode 92 of the burner 9 to the wiring board 5.

The resin case 3' has the above-mentioned configuration, and the burner 9 is fixed to the discharge lamp connector 35 of the resin case 3' by inserting the base 93*a* of the burner 9 into the discharge lamp connector 35 of the resin case 3' and electrically connecting the electrodes 91 and 92 of the burner 9 to the inner-electrode terminal and the outer-electrode terminal 41' by soldering or the like.

Similarly to the first embodiment, the pulse transformer PT is received in the resin case 3' in the stat that the high voltage side of the secondary winding N2 faces the downside and the coil bobbin 20 becomes close to two connection terminals 42 and 43. Both ends of the primary winding N1 wound on the coil bobbin 20 are fixed to the caulking portion 42*a* of the first connection terminal 42 and the caulking portion 43*a* of the second connection terminal 43 in the caulking manner, respectively. The low-voltage end of the secondary winding N2 wound on the core 2 is fixed to the caulking portion 42*b* of the first connection terminal 42 in the caulking manner, and the high-voltage end is fixed to the caulking portion 40*b* of the inner-electrode terminal 40 in the caulking manner. Thereafter, the discharge lamp connector 35 and the reception part 30 are filled with insulating resin 8 such as epoxy resin to improve the insulating property of the pulse transformer PT.

The transformer section TB is constructed as described above, and the circuit section CB is attached to the transformer section TB, similarly to the first embodiment.

That is, In the circuit section CB, as shown in FIG. 10(*a*), one surface of the wiring board 5 mounted with the circuit components such as the capacitor C is opposed to the reception part 30 with the discharge lamp connector 31 of the resin case 3' therebetween and one end in the longitudinal direction at which the capacitor C and the discharge switch SG are mounted is directed to the low voltage side of the secondary winding N2 of the pulse transformer PT. Accordingly, the pulse generating capacitor C and the discharge switch SG are disposed to be opposed to the high voltage area HF including the high voltage side of the secondary winding N2 of the pulse transformer PT and the inner-electrode terminal with the discharge lamp connector therebetween. When the wiring board 5 is disposed in the resin case 3', the wiring board 5 is disposed in a projection plane of the reception part 30 to the wiring board 5. The circuit section CB is attached to the transformer section TB, by mounting the outer-electrode terminal 41' and the connection terminals 42 and 43 on the wiring board 5 by the use of soldering or the like, thereby obtaining an inner apparatus block 10 having the circuit configuration shown in FIG. 15.

The inner apparatus block 12 obtained in this way is received in a protection case 60 for mechanically and electrically protecting the inner apparatus block 12 and a shield case 72 for shielding the inner apparatus block 12 from electronic noises. Accordingly, the high-voltage pulse generator 1' shown in FIG. 12 is completed.

As shown in FIG. 11, the protection case 60 includes a case cover 61 formed in a box shape of which the front surface is opened out of insulating resin and a case body 62 formed in a box shape of which the rear surface is opened out of insulating resin and which is attached to the case cover 61 from the front side. An angular tube-shaped connector case 61*a* of which the top and bottom surfaces are opened to draw out the connection lines L1 to L3 connected to the inner apparatus block 12 is disposed at the substantial center of the lower surface of the case cover 61. On the other hand, a circular hole 62*a* having a size enough to allow the burner 9 to pass (in other words, having an inner diameter substantially equal to the outer diameter of the flange portion 93*b* of the burner 9) is formed in the front surface of the case body 62. A rectangular notched portion 62*b* into which a part of the front side of the connector case 61 is inserted is formed in the bottom surface of the case body 62. The protection case 60 may be filled with insulating resin such as epoxy so as to improve the insulating property at the time of receiving the inner apparatus block 12 in the protection case 60.

As shown in FIG. 11, the shield case 72 includes a rear (back) shield 73 and a front shield 74 which are made of metal. The rear shield 73 is formed in a box shape of which the front surface is opened, a rectangular notched portion 73*a* is formed in the lower side corresponding to the connector case 61*a* of the protection case 60, and a ''ㅋ-shaped' connector shield cover 73*b* covering the rear surface of the connector case 60*a* is integrally protruded from the circumferential edge of the notched portion 73*a*. The front shield 74 is formed in a box shape of which the rear surface is opened, and a circular hole 74*a* having a size enough to allow the burner 9 to pass (in other words, having an inner diameter substantially equal to the outer diameter of the flange portions 93*b* of the burner 9) is formed in the front surface. A rectangular notched portion (not shown) is formed in the lower side corresponding to the connector case 61*a* of the protection case 60 and the 'ㅋ-shaped' connector shield cover 74*b* covering the front side of the connector case 60*a* is integrally protruded from the circumferential edge of the notched portion.

The inner apparatus block 12 is received in the protection case 60 and the shield case 72 as follows. First, the inner apparatus block 12 to which the burner 9 is attached in advance is received in the case cover 61 in the state that the burner is directed forward, and the connection lines L1 to L3 are connected to the power supply terminals 44 to 46 of the inner apparatus block 12 through the connector case 61*a*, respectively. Accordingly, the connector case 61*a* serves as an input portion for connection to power supply lines of an external power source. Thereafter, the case body 62 is attached to the front side of the inner apparatus block 12, the rear shield 73 and the front shield 74 is attached to the protection case in which the inner apparatus block 12 is received, and then the protection case 60 is received in the shield case 72.

In this way, the inner apparatus block 12 is received in the protection case 60 and the shield case 72, thereby completing the high-voltage pulse generator 1' shown in FIG. 12. Since the operation of the high-voltage pulse generator 1' is substantially similar to that of the conventional example, description thereof is omitted.

According to the high-voltage pulse generator 1' according to the third embodiment described above, as shown in FIGS. 10A to 10C, since the discharge lamp connector 35 to which the burner 9 is fitted is disposed in the center line CL1 which passes through the center in the axis direction of the pulse transformer PT and is perpendicular to the axis direction, the distance between the center O' of the discharge lamp connector 35 and the end of the resin case 3', that is, the radius of rotation, can be reduced smaller than that of the conventional example shown in FIG. 14. In addition, as shown in FIG. 5A, when the high-voltage pulse generator is used in the vehicle headlight apparatus 300' and the size of the lamp inserting hole 310*a* is reduced to correspond to the high-voltage pulse generator 1', the installation position of the burner 9 in the lamp housing 310 is not inclined toward a side of the lamp inserting hole 310*a* thanks to the discharge lamp connector 31 having been disposed as described above, thereby not deteriorating the fitting workability.

As shown in FIG. 10(*a*), since the pulse generating capacitor C and the discharge switch SG are disposed to be opposed to the high voltage area HF including the high voltage side of the secondary winding N2 of the pulse transformer PT and the inner-electrode terminal with the discharge lamp connector 35 therebetween (that is, disposed on the opposite side about the center line CL1) and is spaced apart from the high voltage area HF, it is possible to prevent the high voltage from leaking to the low-voltage side circuit LV such as the pulse generating capacitor C and the discharge switch SG without performing an additional insulating process to the capacitor C and the discharge switch SG. Since the circuit components (such as the surge absorber ZNR and the resistor R) of the low-voltage side circuit LV are not disposed in the high voltage area HF, the same advantages can be obtained.

In addition, by together mounting the pulse generating capacitor C and the discharge switch SG at one end in the longitudinal direction of the wiring board 5 and directing the end in the longitudinal direction of the wiring board 5 to the low voltage side of the secondary winding N2 of the pulse transformer PT, the capacitor C and the discharge switch SG are disposed close to the primary winding N1 of the pulse transformer PT. Accordingly, the pulse generating section P is wired as short as possible. That is, since the wiring length of the pulse generating section P, that is, the path through which the pulses pass (large-current path), is reduced, it is possible to improve the electrical characteristic of the high-voltage pulse generator 1', thereby enhancing the performance of the high-voltage pulse generator 1'.

In the high-voltage pulse generator 1' according to the third embodiment, since the discharge lamp (burner) not having a cap is used and the discharge lamp is fixed to the discharge lamp connector 35, the cap and the socket can be omitted in comparison with the first embodiment. Accordingly, it is possible to utilize a large-scaled electronic component as the pulse generating capacitor C or the like and to accomplish the decrease in size of the high-voltage pulse generator.

The high-voltage pulse generator 1 according to the third embodiment can be used in a vehicle assistant lighting apparatus or other lighting apparatus, in addition to the vehicle headlight apparatus 300' described above.

INDUSTRIAL APPLICABILITY

According to the present invention, it is possible to reduce the radius of rotation, to prevent a high voltage generated in the secondary winding from leaking to the low-voltage part circuit such as the high-voltage generating capacitor and the discharge switch, and to improve performance.

The invention claimed is:

1. A high-voltage pulse generator comprising a pulse transformer in which a primary winding and a secondary winding are wound on a rod-shaped core, a discharge lamp connector which is made of an insulating material in a tube shape having an opened front surface thereof and which has therein an electrode electrically connected to a high voltage part of the secondary winding, and a pulse generating capacitor and a discharge switch electrically connected to the primary winding of the pulse transformer, wherein the discharge lamp connector is disposed so that the center thereof is located in a line passing through a substantial center in an axis direction of the pulse transformer and perpendicular to the axis direction, and the capacitor and the discharge switch are disposed to be opposed to the high voltage part of the secondary winding with the discharge lamp connector therebetween.

2. The high-voltage pulse generator according to claim 1, wherein an input portion for connection to a power line of an external power source is disposed to be opposed to the pulse transformer with the discharge lamp connector therebetween.

3. The high-voltage pulse generator according to claim 1, wherein an input portion for connection to a power line of an external power source is disposed to be opposed to the discharge lamp connector transformer with the pulse transformer therebetween.

4. The high-voltage pulse generator according to claim 1, wherein the discharge lamp connector has a socket into which a cap of a discharge lamp is fitted detachably.

5. The high-voltage pulse generator according to claim 1, wherein a discharge lamp is fitted into the discharge lamp connector.

6. A lighting apparatus comprising the high-voltage pulse generator according to claim 1.

7. A vehicle comprising the lighting apparatus according to claim 6.

* * * * *